US009981767B2

(12) United States Patent
Carmichael et al.

(10) Patent No.: US 9,981,767 B2
(45) **Date of Patent: *May 29, 2018**

(54) LABELLING MACHINE AND METHOD WITH MASTER-SLAVE LABELLING GROUPS

(71) Applicant: Sidel S.p.A. CON SOCIO UNICO, Parma (IT)

(72) Inventors: James Carmichael, Parma (IT); Marco Ferri, Parma (IT); Nicola Veneziani, Parma (IT)

(73) Assignee: SIDEL S.P.A. CON SOCIO UNICO, Parma (IT)

( * ) Notice: Subject to any disclaimer, the term of this patent is extended or adjusted under 35 U.S.C. 154(b) by 398 days.

This patent is subject to a terminal disclaimer.

(21) Appl. No.: 14/659,959

(22) Filed: Mar. 17, 2015

(65) Prior Publication Data

US 2015/0274349 A1 Oct. 1, 2015

(30) Foreign Application Priority Data

Mar. 31, 2014 (EP) ..... 14162574

(51) Int. Cl.
*B65C 9/08* (2006.01)
*B65C 9/42* (2006.01)
(Continued)

(52) U.S. Cl.
CPC ..... *B65C 9/42* (2013.01); *B65C 9/0062* (2013.01); *B65C 9/02* (2013.01); *B65C 9/1803* (2013.01);
(Continued)

(58) Field of Classification Search
CPC ..... Y10T 156/1028; Y10T 156/103; Y10T 156/1033; Y10T 156/1744; Y10T 156/1768; Y10T 156/1771; Y10T 156/1773; B65C 3/06; B65C 3/08; B65C 3/14; B65C 3/16; B65C 3/163;
(Continued)

(56) References Cited

U.S. PATENT DOCUMENTS 6,428,639 B1 * 8/2002 Oldenburg ..... B65C 3/08 156/351
2002/0096260 A1 * 7/2002 Yang ..... B65C 3/14 156/351
(Continued)

*Primary Examiner* — Carson Gross
(74) *Attorney, Agent, or Firm* — Finnegan, Henderson, Farabow, Garrett & Dunner, L.L.P.

(57) ABSTRACT

A labelling machine for applying a first label and a second label onto a first article and a second article is disclosed. The labelling machine comprises a first conveyor for conveying a succession of the first article and the second article along a path; a first labelling group, which can be selectively arranged in a first operative configuration; and gap creating means adapted to create a first gap, which is arranged inside the succession and is bounded between the first article and the second article. The first labelling group is selectively arrangeable in a first rest configuration. The labelling machine further comprises a second labelling group, which can be selectively moved between a second rest configuration and a second operative configuration, in which the second labelling group transfers, in use, the second label to the second article.

12 Claims, 21 Drawing Sheets

(51) Int. Cl.

| | |
|---|---|
| ***B65C 9/02*** | (2006.01) |
| ***B65C 9/18*** | (2006.01) |
| ***B65C 9/00*** | (2006.01) |
| ***B65C 9/40*** | (2006.01) |
| *B65C 9/30* | (2006.01) |

(52) U.S. Cl.
CPC ..... *B65C 9/40* (2013.01); *B65C 9/30* (2013.01); *B65C 2009/407* (2013.01); *Y10T 156/1033* (2015.01); *Y10T 156/1089* (2015.01); *Y10T 156/1744* (2015.01); *Y10T 156/1754* (2015.01)

(58) Field of Classification Search
CPC .... B65C 3/26; B65C 9/00; B65C 9/02; B65C 9/18; B65C 9/26
USPC ..... 156/DIG. 8, DIG. 9, DIG. 13, 363, 364
See application file for complete search history.

(56) References Cited

U.S. PATENT DOCUMENTS

2009/0242097 A1* 10/2009 Esposito ..... B65C 9/188 156/64
2011/0056610 A1* 3/2011 Koller ..... B65C 9/40 156/64

* cited by examiner

LABELLING MACHINE AND METHOD WITH MASTER-SLAVE LABELLING GROUPS

CROSS-REFERENCE TO RELATED APPLICATIONS

This application claims the benefit of priority of European Patent Application No. 14162574.9, filed Mar. 31, 2014, which is incorporated herein by reference.

The present invention relates to a labelling group and to a method for applying a plurality of labels onto respective articles, in particular containers filled with a pourable food product.

Labelling machines are known which substantially comprises:

- a rotary carousel, which is fed with first articles and second articles to be labelled at an input station, conveys that first articles and second articles along an arch-shaped path, and outputs the labelled first articles and the labelled second articles to an output station;
- a first labelling group, which feeds and applies a plurality of labels onto respective first articles; and
- a second labelling group, which feeds and applies a plurality of labels onto respective second articles.

Labelling machine is known as "roll-feed", in which the first labelling and the second labelling group substantially comprises, each:

- a shaft for rotatably supporting a reel off which a strip of labels is unwound and fed along a feed path;
- a plurality of unwinding rollers for guiding the strip along a rectilinear feed path;
- a cutter for cutting a sequence of single labels from the strip;
- a transfer drum for advancing each label which has been previously cut; and
- a gluing drum for applying glue onto each previously cut label.

In particular, a conventional transfer drum is rotatable about an axis, comprises an outer surface which receives a succession of cut labels and covered with glue, and releases those labels at an application station after rotation about its own axis of a certain angle.

In particular, the transfer drum conveys the labels tangentially to the outer surface of the first articles and the second articles to be labelled, at the application station.

The first labelling group and the second labelling group apply labels onto respective first article and second article, in order to increase the output rate of the labelling machine.

In particular, the carousel advances a succession of first articles and second articles alternate to each other, while the first labelling group applies labels onto the first articles and simultaneously the second labelling group applies labels onto the second articles.

Under some circumstances, it is necessary to interrupt the operation of the first labelling group or the second labelling group.

This could occur, for example, in case the reel of one of the first labelling group or the second labelling group is terminating and, therefore, a new reel needs to be joined to the existing one.

Alternatively, the operation must be interrupted, in case the first labelling group or the second labelling group is not properly applying the labels onto first articles or second articles respectively.

In the known solutions, the interruption of the operation of the first labelling group or the second labelling group inevitably results in the interruption of the overall labelling machine, with a consequent stop in the production of labelled articles.

Otherwise, either only the first articles or only the second articles would be labelled with the labels.

A need is felt within the industry to interrupt the operation of one of the first labelling group or the second labelling group, without penalizing the final throughput of labelled articles.

It is an object of the present invention to provide a labelling machine for applying labels onto respective articles, which meets the afore-mentioned need in a straightforward, low-cost manner.

According to the present invention, there is provided a labelling unit for applying labels onto respective articles, as claimed in claim 1.

The present invention also relates to a method for applying labels onto respective articles, as claimed in claim 10.

In the following a preferred, non-limiting embodiment of the present invention will be described by way of example with reference to the accompanying drawings, in which.

Figure 1:
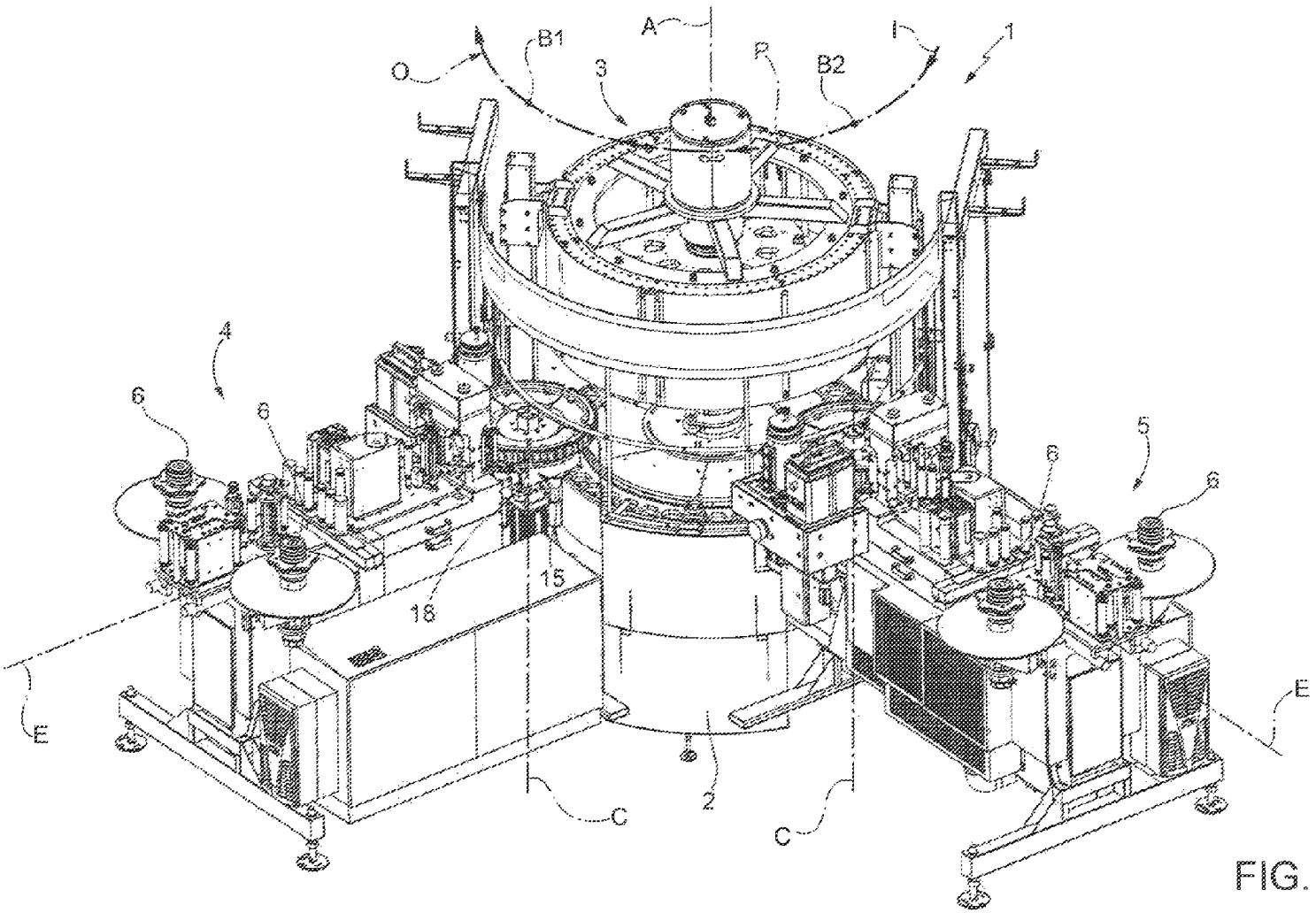
FIG. 1 is a perspective view of a labelling machine with two labelling group according to the present invention.

Number 1 in FIG. 1 indicates as a whole a labelling machine for applying labels 10*a*, 10*b* to respective articles 11, 11*a*, 11*b* (shown in FIGS. 12 to 21), containers for pourable food product in the embodiment shown.

In particular, labelling machine 1 is a so-called "roll-fed" labelling machine.

Labelling machine 1 substantially comprises (FIG. 1):

- a stator 2;
- a carousel 3, which rotates about an axis A, vertical in use, with respect to stator 2, and advances a succession of spaced articles 11, 11*a*, 11*b* along an arc-shaped path P;
- a pair of labelling groups 4, 5, which are arranged on the periphery of carousel 3.

Labelling machine 1 is incorporated in a plant 100 for producing labelling articles 11, 11*a*, 11*b*.

Plant 100 is only partially shown in FIGS. 12 to 21 and substantially comprises:

- a conveyor 101 (shown in FIGS. 12 to 21) for feeding a plurality of pre-forms 108;
- a blowing machine (not-shown) for blowing the pre-forms 108 and forming respective articles 11, 11*a*, 11*b*;
- a filling machine (not-shown) for filling articles 11, 11*a*, 11*b* with the pourable product;
- labelling machine 1; and
- a capping machine (not-shown) for applying a plurality of caps onto respective articles 11, 11*a*, 11*b*.

Alternatively, labelling machine 1 could be interposed between the blowing machine and the filling machine.

In greater detail, path P comprises:

- an input station I, at which carousel 3 is fed with articles 11, 11*a*, 11*b* to be labelled; and
- an output station O, at which carousel 3 outputs labelled articles 11, 11*a*, 11*b*.

Proceeding according to the advancing direction of articles 11, 11*a*, 11*b* from station I to station O, path P comprises:

- an application station B2; and
- an application station B1.

In the embodiment shown, path P is shaped as an arch of circumference having centre on axis A.

Labelling groups 4, 5 are arranged peripherally with respect to carousel 3.

Each labelling groups 4, 5 substantially comprises (FIGS. 2 and 12 to 21):

- a pair of shafts 6 for rotatably supporting relative reels 7*a*, 7*b* (shown only in FIGS. 12 to 21) off which a strip 8 of labels 10*a*, 10*b* is unwound and fed along a feed path towards application station B1, B2;
- a plurality of unwinding rollers 16 for guiding strip 8 along the feed path;
- a cutting element 9 for cutting, one after the other, labels 10 from strip 8;
- a glue roller 12 for applying glue onto cut labels 11; and
- a transfer element 13 for transferring cut and glue-covered labels 10*a*, 10*b* along an arc-shaped trajectory Q having centre on an axis C from an input station J either to application station B1, B2 or to a discarding station D.

Labelling group 4 can be selectively arranged in a first operative position (FIGS. 12 to 14), in which it applies, at application station B1, a succession of labels 10*a* onto respective articles 11*a*.

Advantageously, labelling machine 1 comprises a gap creating element 110 (FIGS. 12 to 21) for creating gap 82, which is arranged inside the succession of articles 11, 11*a*, 11*b*.

Furthermore, labelling group 4 is selectively arrangeable in a first rest configuration (FIGS. 15 to 18 and 19 to 21), in which it is prevented from transferring labels 10*a* to articles 11*a*.

Labelling group 5 is selectively movable between:

- a second operative configuration, in which it transfers labels 10*b* to respective articles 11*b* at application station B2 (FIGS. 15 to 17 and 21)
- a second rest configuration, in which it is prevented from transferring labels 10*b* to respective articles 11*b* at application station B2 (FIGS. 12 to 14 and 19 and 20).

In particular, before gap 82 is created, one (4 in FIGS. 12 to 21) of labelling group 4, 5 acts as a "master" labelling group and is arranged in the first (or second) operative configuration while the other (5 in FIGS. 12 to 21) of labelling group 4, 5 acts a "slave" labelling group and is arranged in the second (first) rest configuration.

When gap 82 is created, labelling group 4 (5) previously acting as the "master" labelling group is moved to the first (second) rest configuration and becomes the "slave" labelling group, while labelling group 5 (4) acting as the "slave" labelling group moves to the second (first) operative configuration and becomes the "master" labelling group.

In other words, either labelling group 4 (5) is in the first (second) operative configuration or labelling group 5 (4) is in the second (first) rest configuration, during the application of labels 10*a* (10*b*) onto articles 11, 11*a* (11, 11*b*).

As it will be evident in the following of the present description, when labelling group 4 (5) is in the first (second) operative configuration, transfer element 13 transfers labels 10*a* (10*b*) to first (second) articles 11*a* (11*b*) at application station B1 (B2), and transfer element 13 is tangent to articles 11*a* (11*b*) travelling along path P at application station B1 (B2).

Conversely, when labelling group 4 (5) is in the first (second) rest configuration, transfer element 13 is prevented from transferring labels 10*a* (10*b*) to first (second) articles 11*a* (11*b*) at application station B1 (B2), and transfer element 13 is spaced from application station B1 (B2).

In greater detail, gap 82 is bounded by an adjacent downstream article 11*a* and an immediately adjacent upstream article 11*b*, proceeding according to the advancing direction of articles 11, 11*a*, 11*b* along path P.

Figure 12:
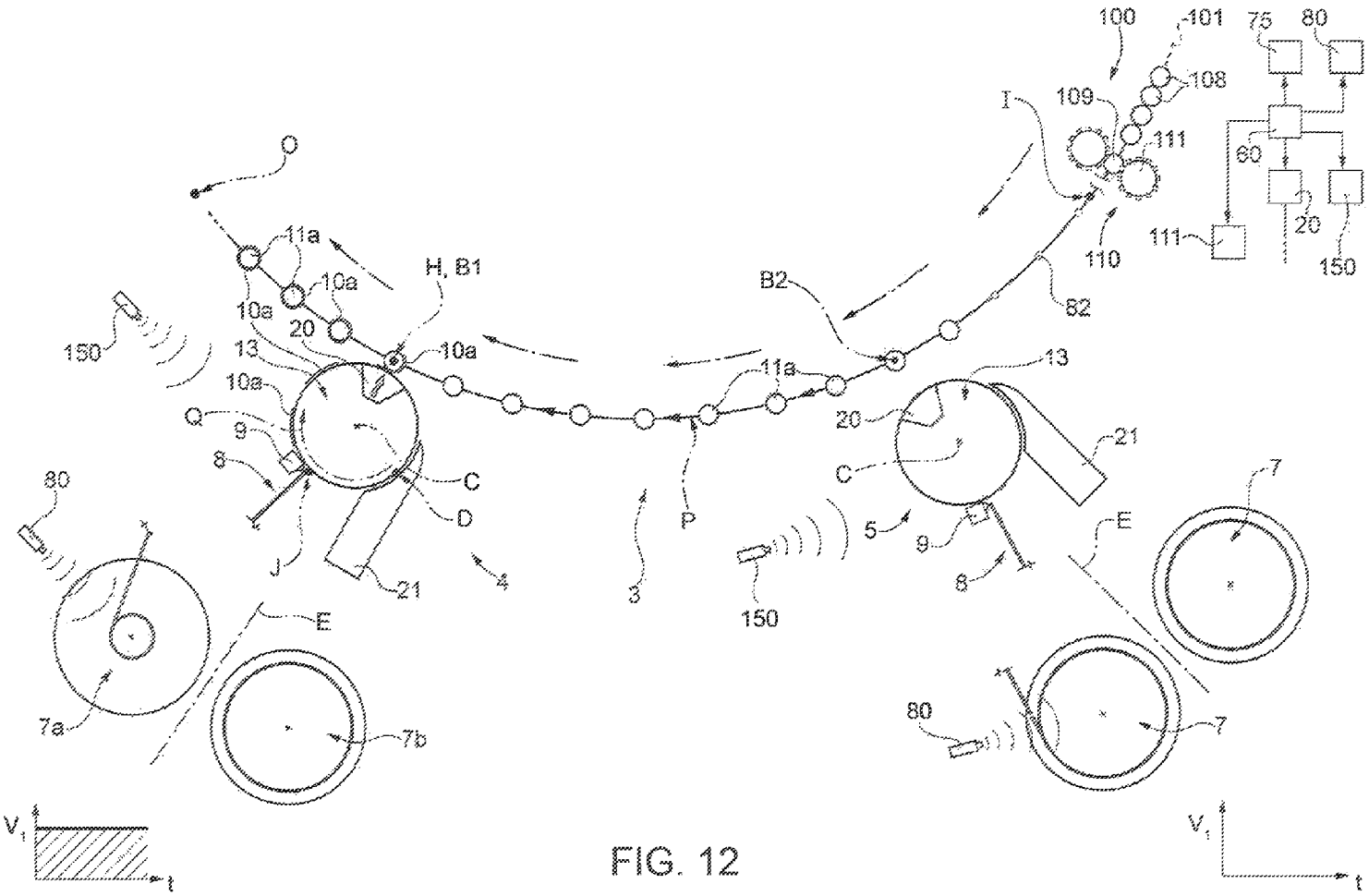
FIGS. 12 to 18 are schematic views of the labelling machine of FIG. 1 representing respective subsequent steps of a first operative scenario.
Figure 13:
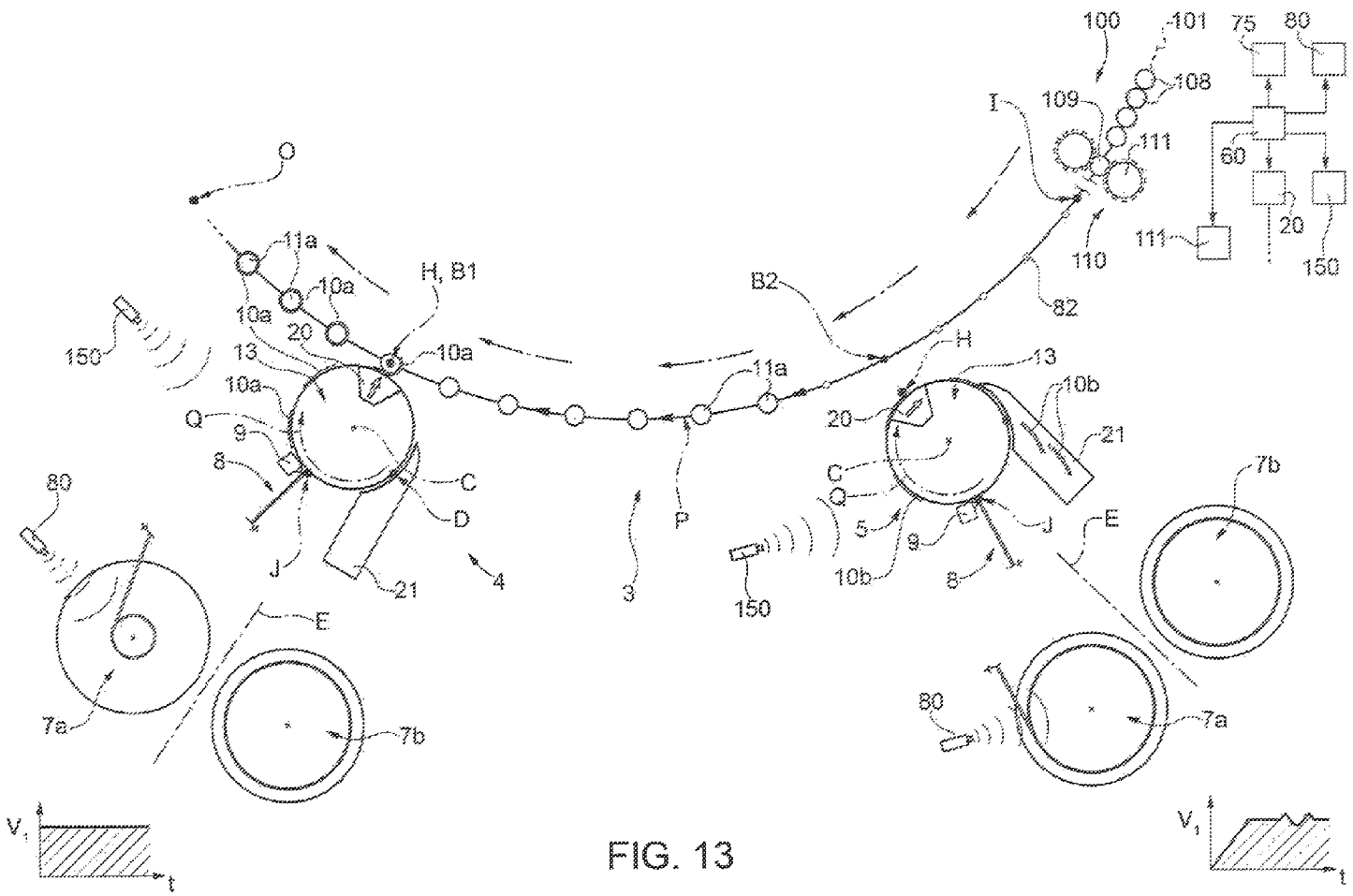
Figure 14:
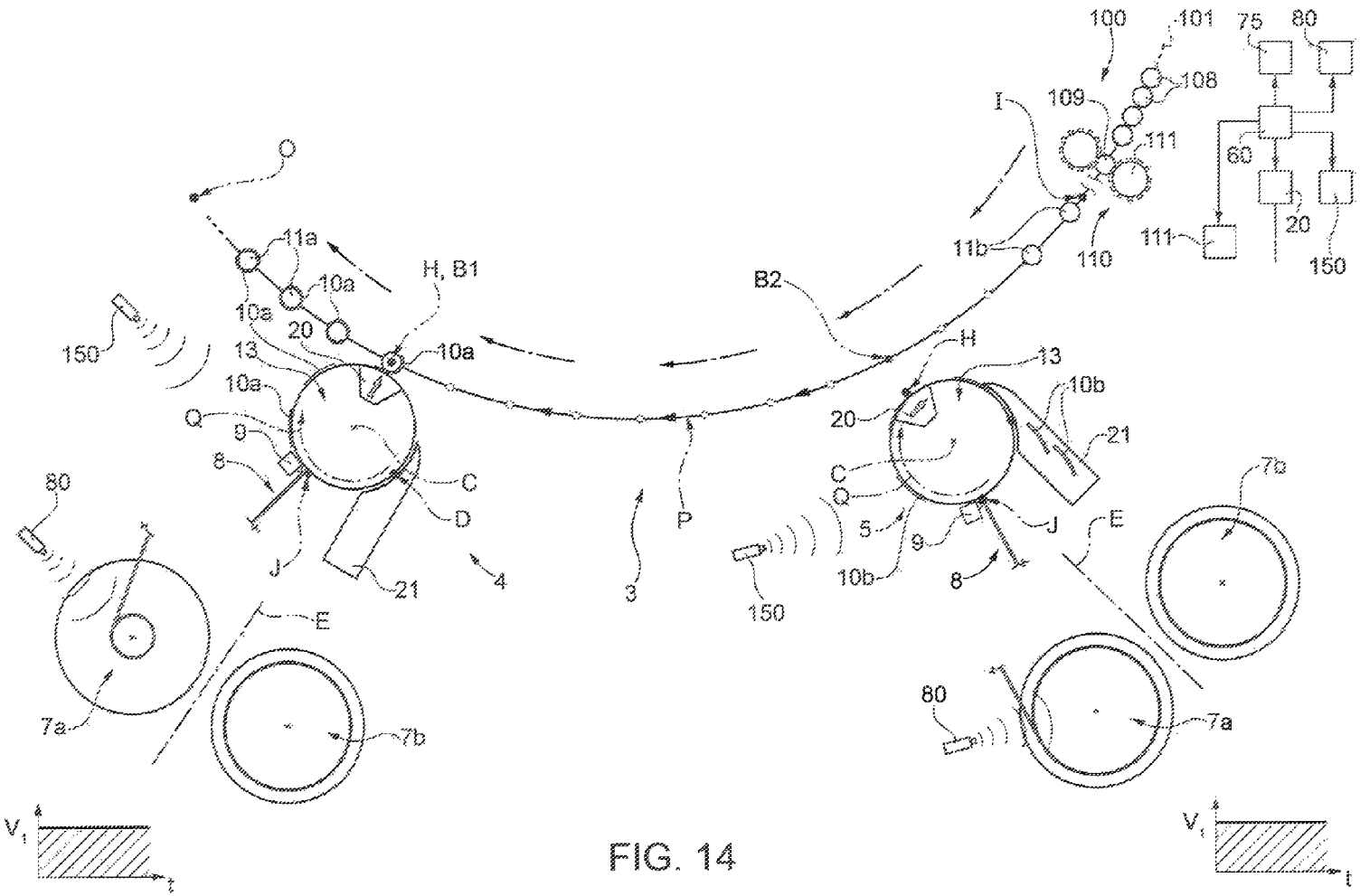

With reference to FIGS. 12 to 21, control unit 60 is programmed for moving labelling group 4 from the first operative configuration to the first rest configuration, after labelling group 4 has transferred labels 10*a* onto immediately adjacent downstream article 11*a* (FIG. 14).

Figure 15:
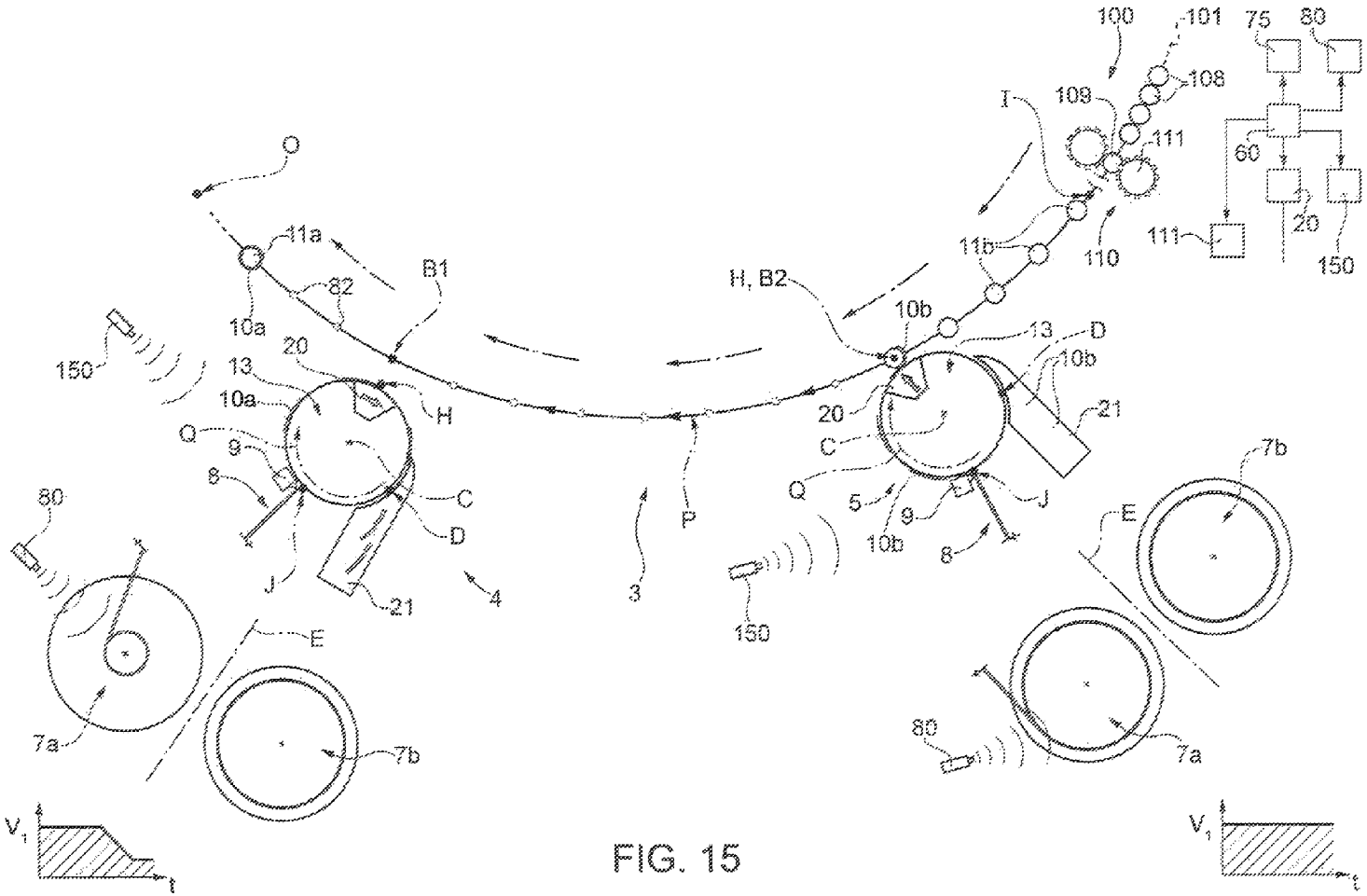
Figure 16:
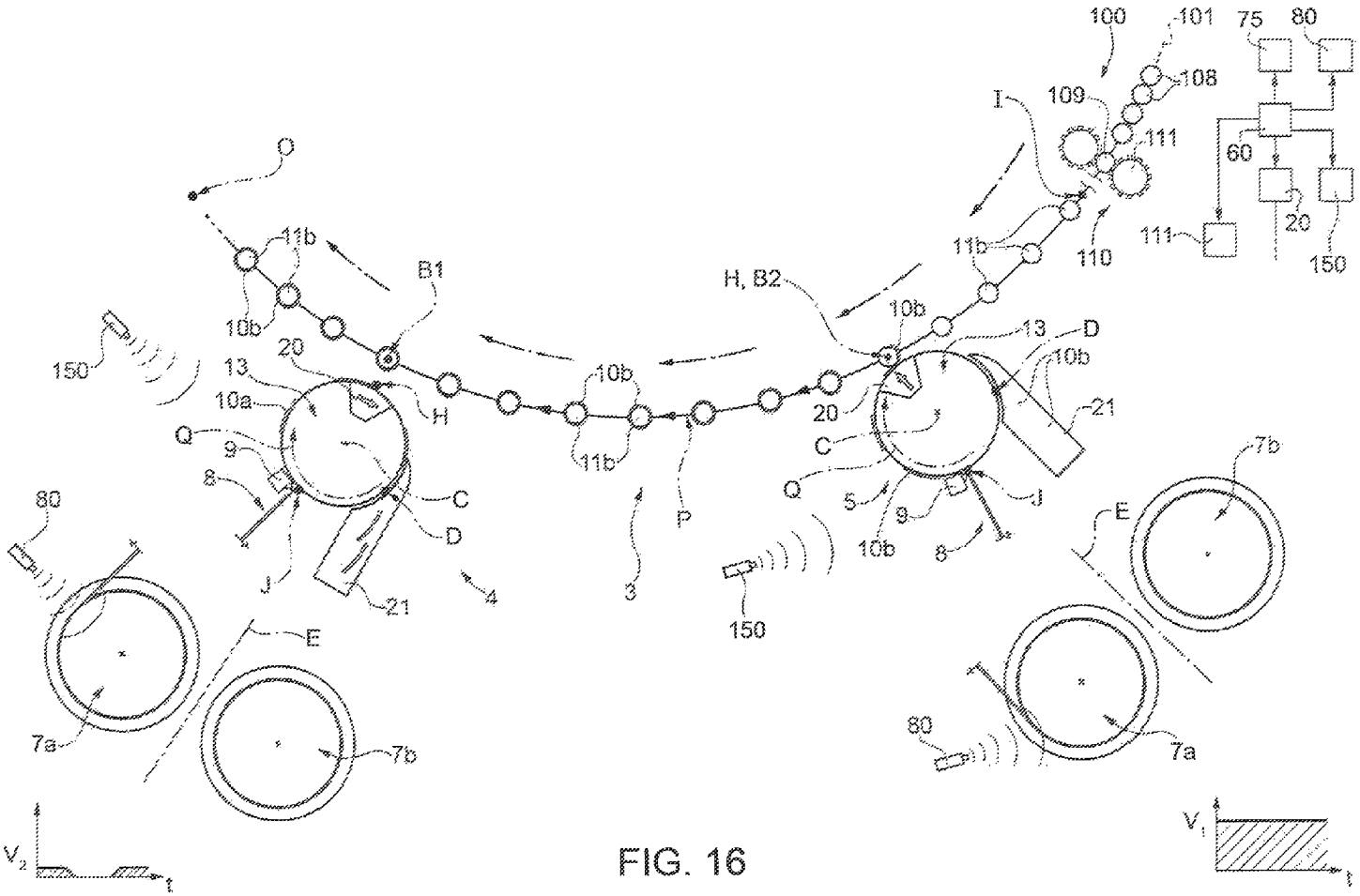

Furthermore, control unit 60 is programmed for moving labelling group 5 from the second rest configuration to the second operative configuration, before labelling group 5 transfers labels 10*b* onto immediately adjacent upstream article 11*b* (FIG. 15).

Figure 20:
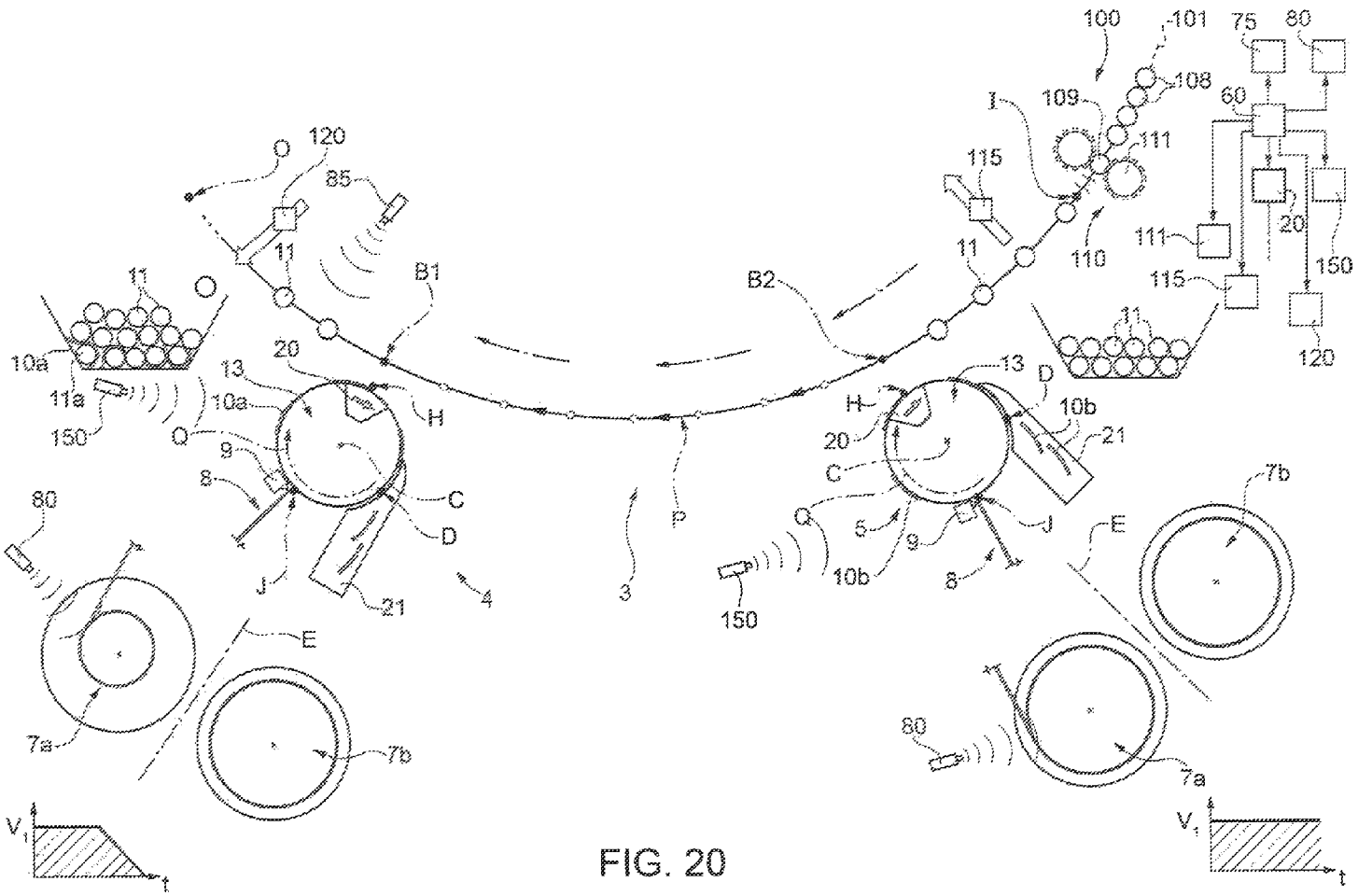

Control unit 60 is also programmed for moving first labelling group 4 from the first operative position to the first rest position and for moving labelling group 5 from the first rest position to the second operative position, when gap 82 travels along path P and between application stations B1, B2 (FIGS. 15 and 20).

In this way, none of articles 11*a*, 11*b* remains unlabelled.

Labelling machine 1 further comprises (FIGS. 12 to 18):

- a sensor 80 (only schematically shown) for generating a signal associated to the fact reel 7*a* of labelling group 4 (or 5) is terminating; and
- a visual control system 150, a camera in the embodiment shown, which controls the correct positioning of labels 10*a*, 10*b* conveyed by transfer element 13.

Furthermore, gap creating element 110 comprises a switch 111 (only schematically shown) for interrupting the flow of pre-forms 108 along conveyor 101 and for creating, therefore, a gap 109 inside that flow.

In particular, switch 111 is operated to interrupt the flow of pre-forms 108 along conveyor 101, as a consequence of the signal generated by sensor 80.

Starting from a situation in which labelling group 4 is in the first operative configuration and labelling group 5 is in the second rest configuration, control unit 60 is programmed, as a consequence of the signal generated by sensor 80 (as shown in FIG. 12), for:

- moving labelling group 4 (5) from the first (second) operative configuration to the first (second) rest configuration; and
- moving labelling group 5 from the second (first) rest position to the second (first) operative configuration.

In particular, control unit 60 is programmed for:

moving transfer element 13 (and therefore strip 8) of labelling group 4 (5) at a substantially highest first speed V1, when the latter is in the operative configuration;

decelerating transfer element 13 (and therefore strip 8) of labelling group 4 (5) from highest first speed V1 to a second speed V2 lower than speed V1 and then to a null speed, so as to allow the splicing of a new reel 7*b* to the existing reel 7*a*.

In particular, speed V1 is associated and equal, in the embodiment shown, to the speed of conveyor 3 along path P.

Control unit 60 is also programmed, after the joining of new reel 7*d* to reel 7*a*, and with the labelling group 4 (5) in the rest position, for moving transfer element 13 (and therefore strip 8) of labelling group 4 (5) at second speed V2 lower than highest first speed V1;

accelerating transfer element 13 (and therefore strip 8) of labelling group 4 (5) at a third speed V3 higher than second speed V2 and lower than highest first speed V1; and decelerating transfer element 13 (and therefore strip 8) of labelling group 4 (5) up to a null speed.

Furthermore, control unit 60 is programmed for accelerating transfer element 13 of labelling group 5 (4) from a null-speed to highest first speed V1 according a linear ascending ramp (FIG. 13).

In particular, as shown in FIG. 13, drum 15 of labelling group 5 (4) reaches highest first rotational speed V1 before labelling group 5 (4) reaches the first (second operative) configuration.

Figure 19:
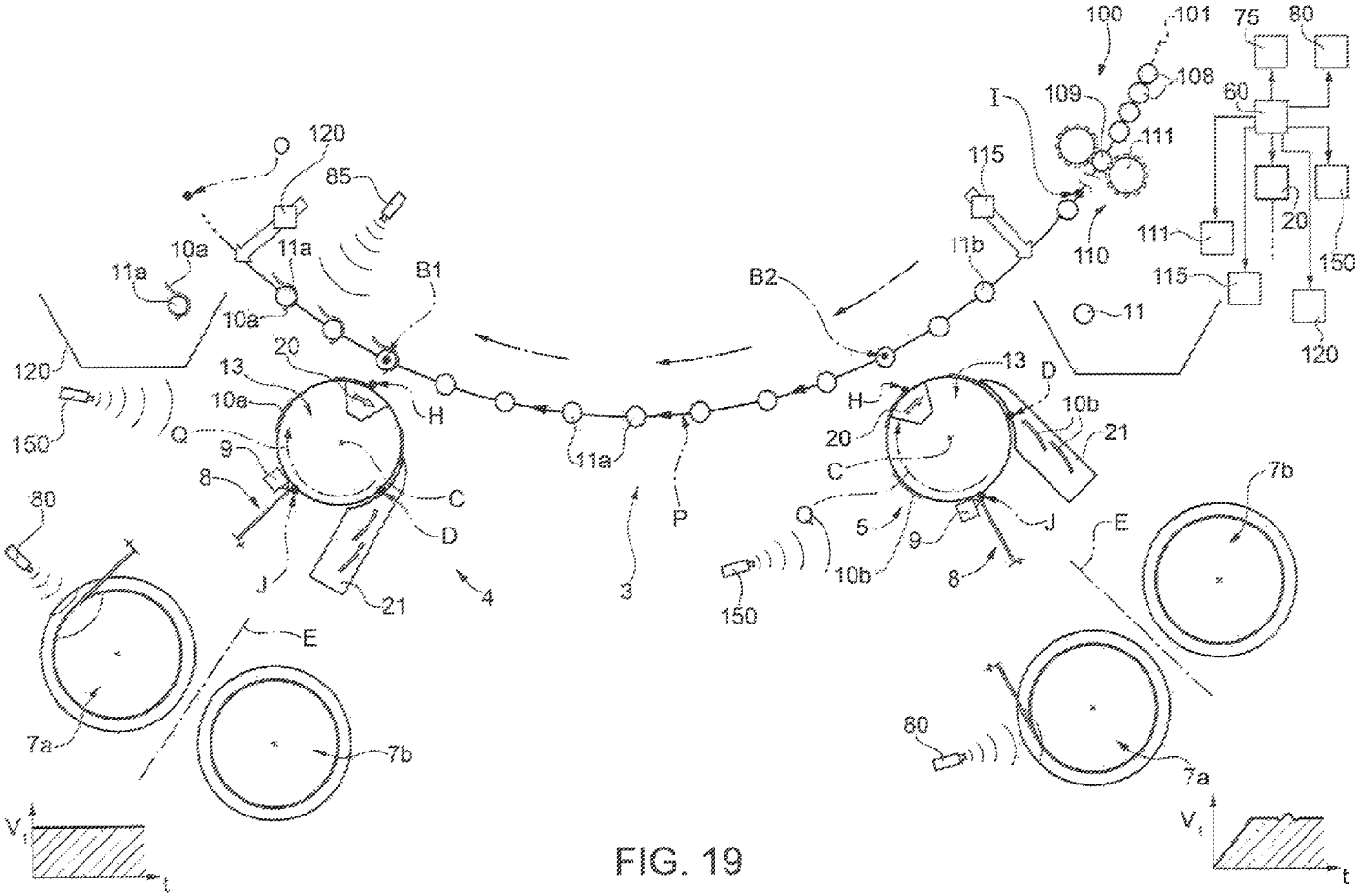
FIGS. 19 to 21 are schematic views of the labelling machine of FIG. 1 representing respective subsequent steps of a second operative scenario.
Figure 21:
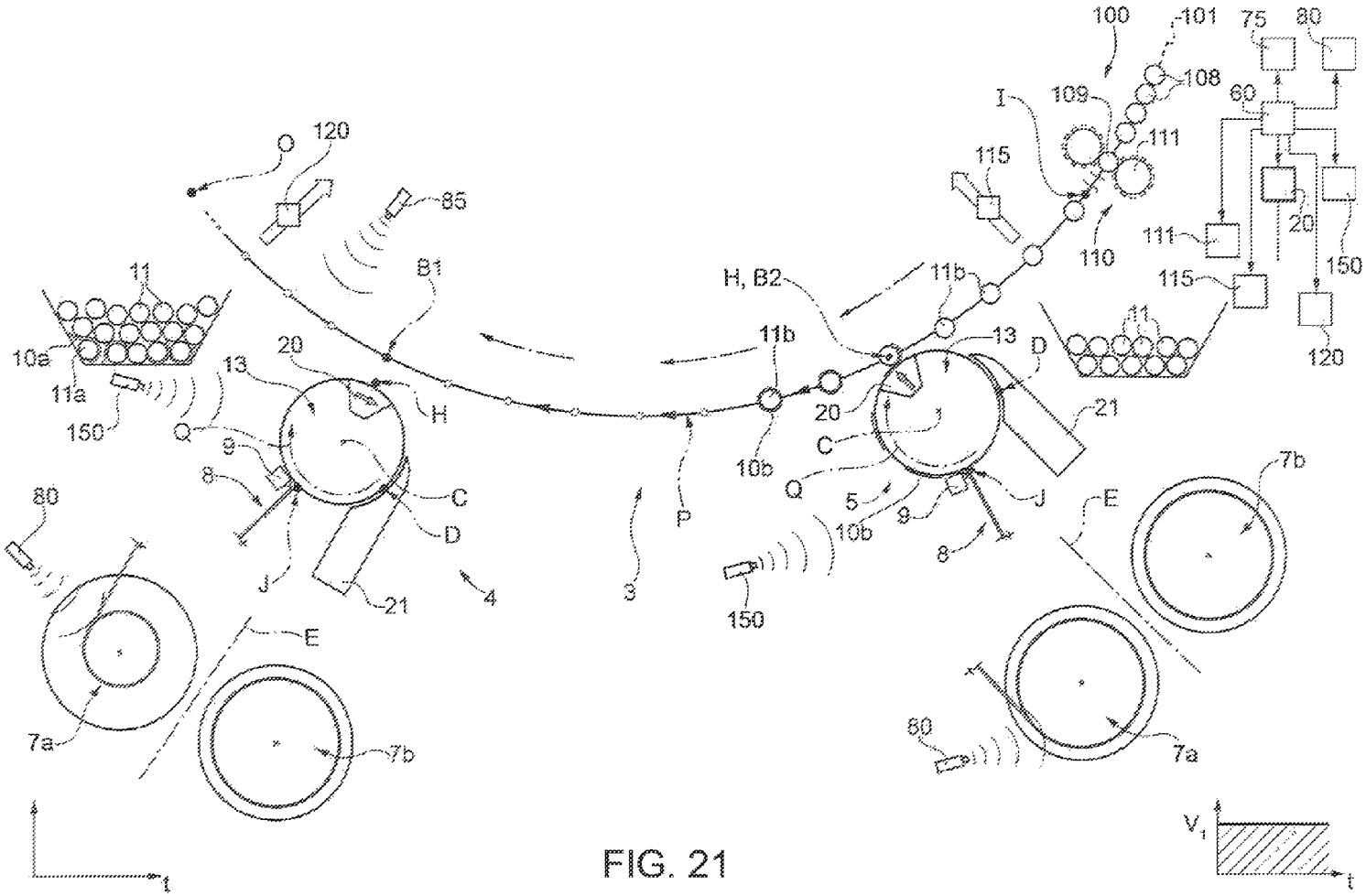

With reference to FIGS. 19 to 21, labelling machine 1 further comprises:

a sensor 85 for detecting that labelling group 4 (5) is not properly applying respective labels 10*a* (10*b*) onto respective articles 11*a* (11*b*) at application station B1 (B2);

an expelling device 115 (only schematically shown) selectively controllable for expelling not properly labelled articles 11*b* upstream of application station B1 and/or B2, proceeding according to the advancing direction of articles 11, 11*a*, 11*b* *along path P; and* an expelling device 120 (only schematically shown) for expelling not properly labelled articles 11*a*, 11*b* downstream of application stations B1 and/or B2, proceeding according to the advancing direction of articles 11, 11*a*, 11*b* along path P.

In particular, expelling device 115, expels articles 11, as a consequence of the signal generated by sensor 85.

Expelling device 120 expels articles 11*a*, 11*b*, as a consequence of the signal generated by sensor 85.

Control unit 60 is programmed, as a consequence of the signal generated by sensor 85, for (FIGS. 19 to 21):

moving labelling group 4 (5) from the first operative configuration to the first rest configuration; and moving labelling group 5 (4) from the second rest configuration to the second operative configuration.

Furthermore, control unit 60 is programmed, while transfer element 13 of labelling group 4 (5) moves from the first (second) operative configuration to the first (second) rest configuration, for decelerating transfer element 13 of labelling group 4 (5) form highest first speed V1 to a null speed, according to a linear descending ramp in the embodiment shown (FIG. 20); and accelerating transfer element 13 of labelling group 5 (4) from a null speed to highest first speed V1, according to a linear ascending ramp in the embodiment shown (FIG. 19).

Preferably, transfer element 13 (and therefore strip 8) of labelling group (5) stops, before labelling group 4 (5) reaches the first (second) rest position.

In a completely analogous way, transfer element 13 (and therefore strip 8) of labelling group 5 (4) preferably reaches highest first speed V1, before labelling group 4 (5) reaches the second (first) operative position.

Figure 2:
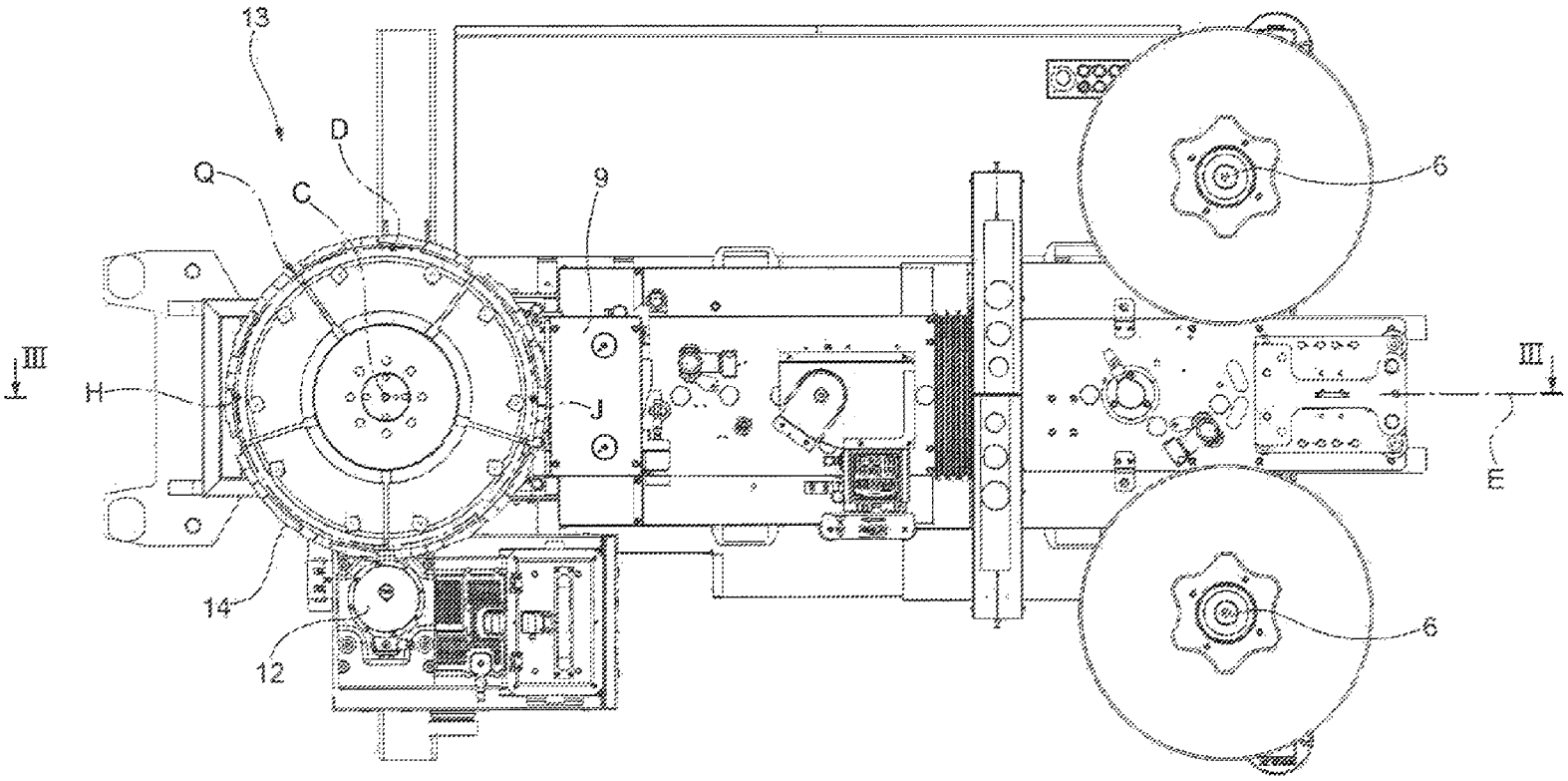
FIG. 2 is a top view of one of the labelling group of FIG. 1.

In particular, transfer system 13 transfers labels 10*a*, 10*b* to be applied on respective articles 11*a*, 11*b* from input station J to transfer station H, whereas it transfers labels 10*a*, 10*b* to be discarded from input station J to discarding station D (FIG. 2).

During application of labels 10*a*, 10*b* on relative articles 11*a*, 11*b* transfer element 13 of labelling group 4, 5 is arranged in an operative position, in which trajectory Q is tangent to articles 11*a*, 11, 11*b* travelling along path P at application station B1 (B2).

In greater detail, when transfer element 13 of labelling group 4, 5 is in the operative position, transfer station H is coincident with respective application station B1, B2.

Discarding station D is arranged downstream of transfer station H, proceeding according to the advancing rotation direction of drum 15.

Application station B1, B2 is arranged at a first angular distance from input station P and discarding station D is arranged at a second angular distance form station J. The second angular distance is greater than the first angular distance (FIG. 2).

Axis C is parallel and distinct from axis A.

With reference to FIGS. 1, 10, 11 and 12 to 21, transfer system 13 of each labelling group 4, 5 substantially comprises:

a stator 14;

a drum 15, which is supported on stator 14 in a rotatable manner about axis C;

a diverting device 20, which can be arranged in a first configuration (shown in FIGS. 12 to 21 by a substantially vertical arrow directed towards carousel 3) in which it allows drum 15 to transfer labels 10*a*, 10*b* to be applied onto respective articles 11*a*, 11, 11*b* from station J to transfer station H, or in a second configuration (shown in FIGS. 12 to 21 by a substantially horizontal arrow directed towards discarding station D) in which it allows drum 15 to transfer labels 10*a*, 10*b* to be discarded from station J to discarding station D; and a sucking device 21 (only schematically shown in FIGS. 12 to 21), which is arranged at discarding station D and which receives labels 10*a*, 10*b* to be discarded at discarding station D.

Visual control system 150 controls, in use, the correct positioning of labels 10*a*, 10*b* in sucking device 21 at discarding station D. Alternatively or in combination, visual control system 150 controls the positioning of labels 10*a*, 10*b* on drum 15, upstream of cutting element 9.

Figure 10:
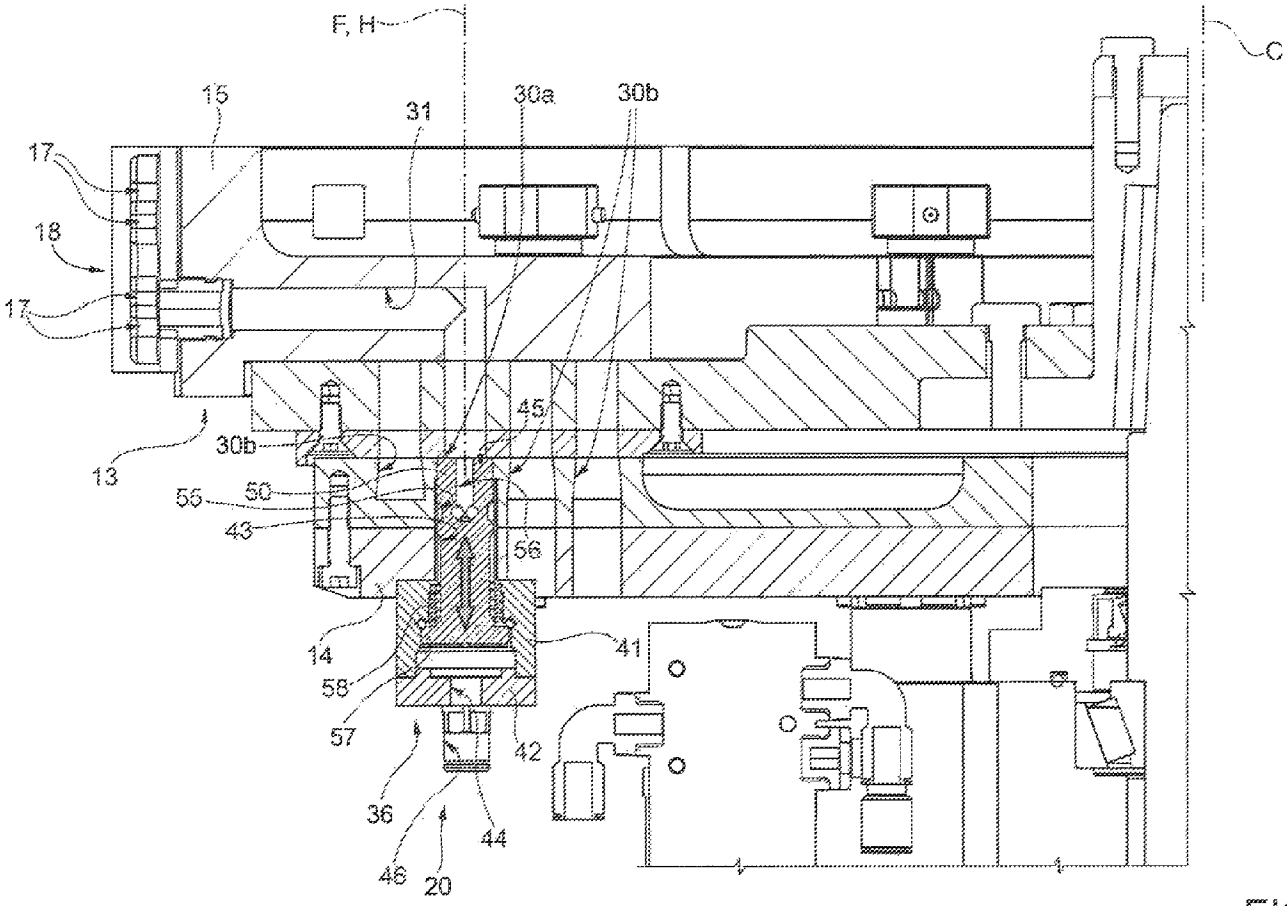
FIGS. 10 and 11 are enlarged sections of the labelling group of FIGS. 2 to 10, showing respectively the diverting device in a first configuration and in a second configuration.
Figure 11:
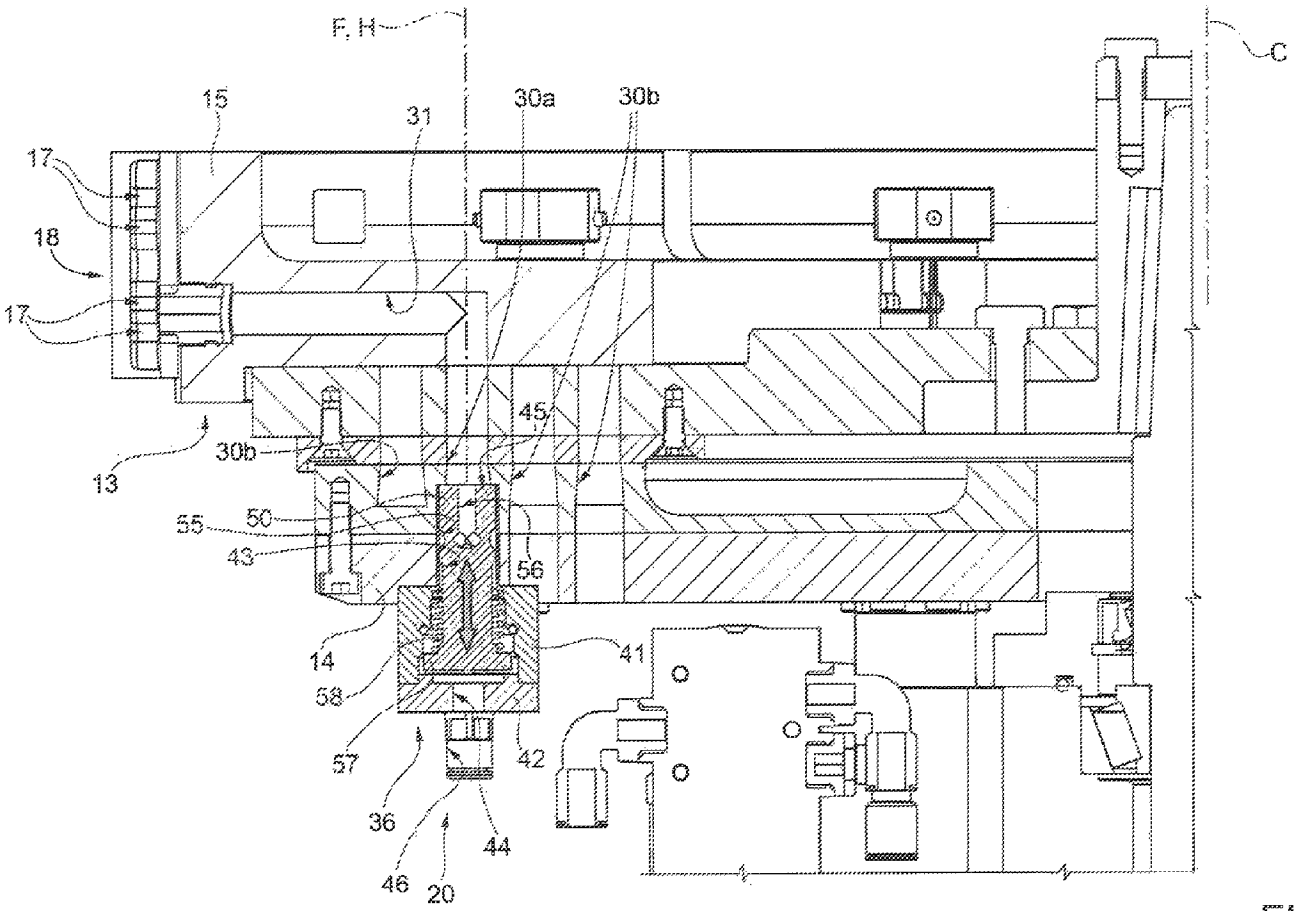

Stator 14 comprises, in turn, a plurality of vacuum sources arranged in respective, stationary channels 30*a*, 30*b* shaped as arch having centre on axis C (FIGS. 10 and 11).

Drum 15 is independently driven by a motor (not shown) about axis C.

Drum 15 comprises, in turn, a lateral outer surface 18 extending cylindrically about axis C.

Surface 18 comprises a plurality, five in the embodiment shown, of conveying sections adapted, to convey respective labels 10*a*, 10*b* along the arch-shaped trajectory.

Each conveying section is circumferentially bounded by an upstream elastic pad and by a downstream elastic pad, which are angularly spaced from one another.

Drum 15 comprises (FIGS. 10 and 11):

a plurality of channels 31 (only one of which is shown in FIGS. 10 and 11), shaped as arches having common centre on axis C; and a plurality of air ports 17 defined by surface 18 and arranged both in conveying sections and in downstream pad and upstream pad.

Channels 30*a*, 30*b*; 31 extend at given distances from axis A and for given arches about axis C.

In particular, for some angular positions of drum 15, one of channels 31 is superimposed to at least one respective channel 30*a*, 30*b*.

In this way, air ports 17 are connected to the vacuum source and can exert a suction action on label 10*a*, 10*b*.

For some other angular positions of drum 15, channels 31 interact with different section of channels 30*a*, 30*b*.

Accordingly, for these other angular positions of drum 15, air ports 17 are fluidly disconnected from the vacuum source and do not exert any suction action on label 10*a*, 10*b*.

In greater detail, at station J, air ports 17 of the upstream pad of each conveying section are fluidly connected with the vacuum source, so as to suck the trailing edge of respective label 10*a*, 10*b*.

As each conveying section rotates about axis C from station J to transfer station H, respective air ports 17 of that convoying station and of the downstream pad are connected with the vacuum source, so as to suck the remaining part of respective label 10*a*, 10*b*.

In this way, each label 10*a*, 10*b* is advanced from station J to transfer station H with its leading edge held on the upstream pad and its trailing edge held on the downstream pad.

In particular, when each label 10*a*, 10*b* reaches transfer station H, channels 30*a*, 31 are superimposed.

When diverting device 20 is arranged in the first configuration, the fluidic connection between air ports 17 travelling at transfer station H and the vacuum source is interrupted.

In this way, each label 10*a*, 10*b* is gradually released by drum 15 and transferred outside drum 15 at transfer station H.

As it will evident from the foregoing of the present description, when diverting device 20 is arranged in the first configuration, air ports 17 travelling at transfer station H eject an air jet on label 10*a*, 10*b*, so as to ease the release of labels 10*a*, 10*b* at transfer station H.

When diverting device 20 is arranged in the second configuration, the fluidic connection between air ports 17 travelling at transfer station H and the vacuum source is maintained.

Furthermore, when diverting device 20 is arranged in the second configuration, air ports 17 do not eject any air jet on labels 10*a*, 10*b* travelling at transfer station H.

In this way, labels 10*a*, 10*b* can reach discarding station D, whereat they are sucked by sucking device 21.

Diverting device 20 substantially comprises (FIGS. 8, 9 to 11):

a plurality of electro-valves 35*a*, 35*b*, 35*c*; and an actuator 36, which is controlled by electro-valve 35*a*, 35*b*, 35*c* for selectively interrupting the fluidic connection between air ports 17 travelling at transfer station H and the vacuum source, and for selectively causing air ports 17 travelling at transfer station H to eject a jet of air onto label 10*a*, 10*b* so as to ease the release of label 10*a*, 10*b* at transfer station H.

In greater detail, actuator 36 is arranged on stator 14 at transfer station H and comprises, in turn:

a housing 41 fitted to stator 14; and a shutter 45 (or locking piston) movable inside a seat 43 of housing 41 along an axis F parallel to axis C between a first position and a second position; and a flange 42 fitted to housing.

Seat 43 opens, on one side, in channel 30*a* and, on the other side, in a hole 44 of flange 42 which is connected to electro-valve 35*a* by a duct 46.

Shutter 45 comprises, in turn:

a stem 50 elongated along axis F and arranged on the side of channel 30*a*; and a base 57 enlarged with respect to stem 50, orthogonal to axis F, and arranged on the side of flange 42.

Stem comprises an annular groove 55 which extends about axis F.

Furthermore, stem 50 defines a duct 56 which is fluidly connected with groove 55 and is fluidly connected with channel 30*a* (FIGS. 8, 9, 10 and 11).

When shutter 45 is in the first position (raised in FIG. 10), stem 50 fully engages channel 30*a*, thus interrupting the fluidic connection between the vacuum source and channel 31 connected to air ports 17 travelling at transfer station H. In this way, no vacuum action is exerted on label 10 travelling at transfer station H.

Furthermore, when the shutter 45 is in the first position, base 57 is spaced along axis F from flange 42 and abuts against a shoulder defined by housing 41.

When the shutter 45 is in the second position, stem 50 leaves free part of channel 30*a*, thus maintaining the fluidic connection between the vacuum source and channel 31*a* connected to air ports 17 travelling at transfer station H. In this way, the vacuum action is exerted on labels 10*a*, 10*b* travelling at transfer station H.

Furthermore, when the shutter 45 is in the second position, base 57 contacts flange 42 and is spaced by shoulder.

Electro-valve 35*a* can be actuated for generating a flow of air in pressure inside duct 46, thus increasing the pressure in the volume between flange 42 and base 57 and causing shutter 45 to move from the second position to the first position parallel to axis F.

Base 57 is elastically connected to flange 42 by a spring 58, which causes the return of shutter 45 from the first position to the second position.

Figure 9:
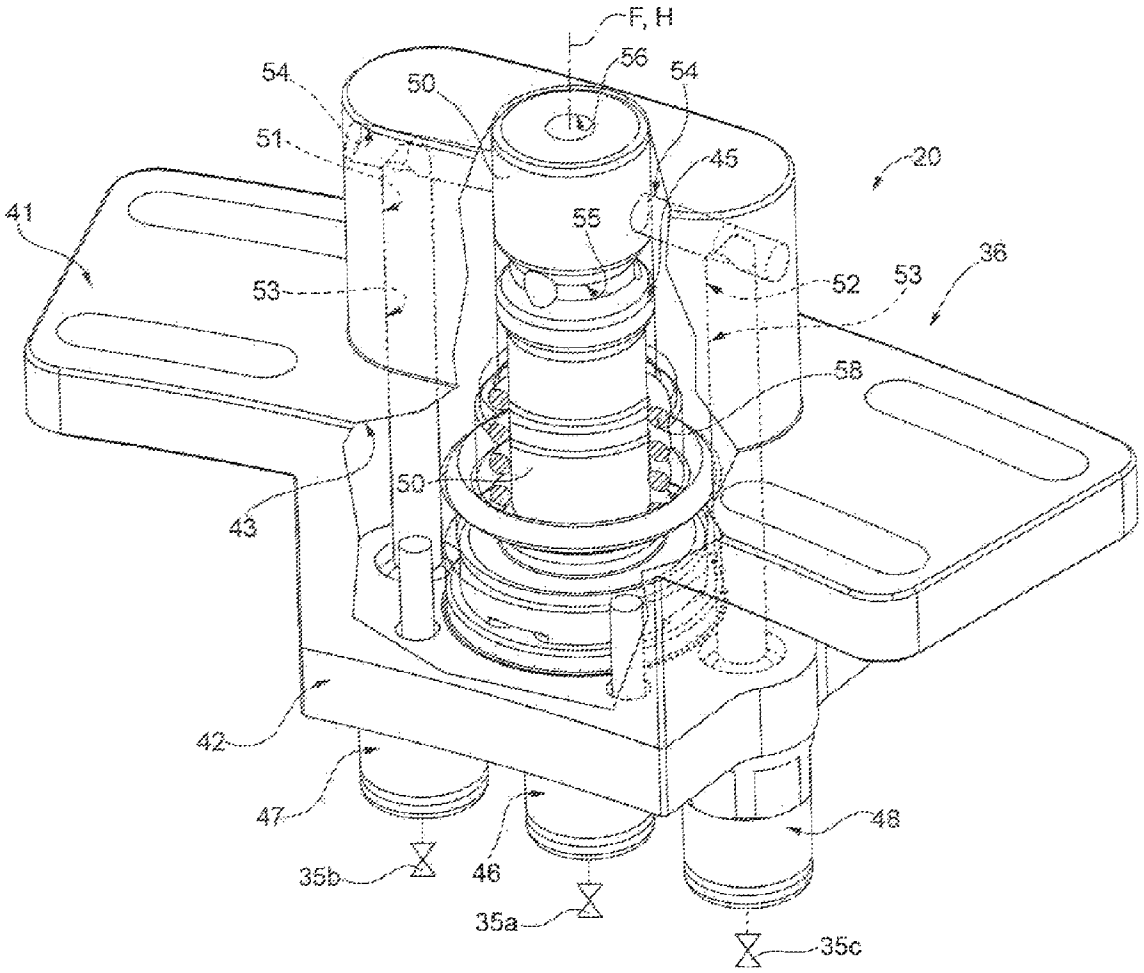
FIG. 9 is a further enlarged view of the diverting device of FIG. 8.

Housing 41 also comprises a pair of channels 51, 52, between which seat 43 is arranged (FIG. 9).

Each channel 51, 52 is fluidly connected, on one side thereof, to a respective duct 47, 48.

Each channel 51, 52 is fluidly connected with air ports 17 set at transfer station H, when shutter 45 is in the first position.

Each channel 51, 52 is fluidly isolated by air ports 17 set at transfer station H, when shutter 45 is in the second position.

More precisely, each channel 51, 52 also comprises:

a portion 53 parallel to axis F and originating from a hole 49*a*, 49*h* (FIG. 8) of flange 42 connected to electro-valve 35*b*, by means of respective ducts 47, 48; and a portion 54 (shown in FIG. 9) orthogonal to axis F and opposite to respective hole 49*a*, 49*b* of flange 42.

When shutter 45 is in the first position, groove 55 faces portions 54 of channels 51, 52, thus establishing a fluidic connection between ducts 47, 48 and air ports arranged at transfer station H, by means of superimposed channels 30*a*, 31.

In this way, when shutter 45 is in the first position (FIG. 10), air ports 17 travelling at transfer station H eject a jet of air on label 10*a*, 10*b*.

When shutter 45 is in the second position (FIG. 11), groove 55 is staggered from portion 54 along axis F, thus fluidly isolating ducts 47, 48 and air ports 17 travelling at transfer station H.

Accordingly, when shutter 45 is in the second position, no jet of air is ejected on label 10 travelling at transfer station H.

Transfer element 13 of each labelling group 4, 5 is also movable in a fully rest position, in which trajectory Q is spaced from application station B1, B2.

In greater detail, transfer station H is spaced from application station B1, B2 when transfer element 13 of labelling group 4, 5 is in the fully rest position.

When labelling group 4 (5) is in the first (second) operative configuration, respective diverting device 20 is set in the first (second) configuration and respective transfer element 13 is in the first (second) operative position.

When labelling group 4 (5) is in the first (second) rest configuration, respective diverting device 20 is set in the second configuration and respective transfer element 13 is in the fully rest position.

Transfer element 13 can also assume a plurality of partially rest positions (not shown in FIGS. 12 to 21), which are interposed between the operative position and the fully rest position.

Accordingly, labelling group 4 (5) can assume a plurality first (second) partially rest configuration, which are interposed between the first (second) operative configuration and the first (second) rest configuration.

Preferably, diverting device 20 is set in the second configuration, when transfer element 13 is set in one of the partially rest positions.

In particular, transfer element 13 is movable between the fully rest position and the operative position along a rectilinear path parallel, to a direction E.

Direction E is, in the embodiment shown, radial to path P and trajectory Q and lies on a plane orthogonal to axes A, C.

Each labelling group 4, 5 further comprises (FIGS. 3 to 7):

- a supporting structure 65 which supports shaft 6;
- a supporting structure 66 which supports transfer element 13; and
- connecting means 67 interposed between supporting structures 65, 66 and programmed so allow supporting structures 65, 66 to move with respect to each other parallel to direction E, so as to allow transfer element 13 to move between the fully rest position and the operative position.

In the embodiment shown, supporting structure 66 also supports cutting element 9 and glue roller 12.

Figure 6:
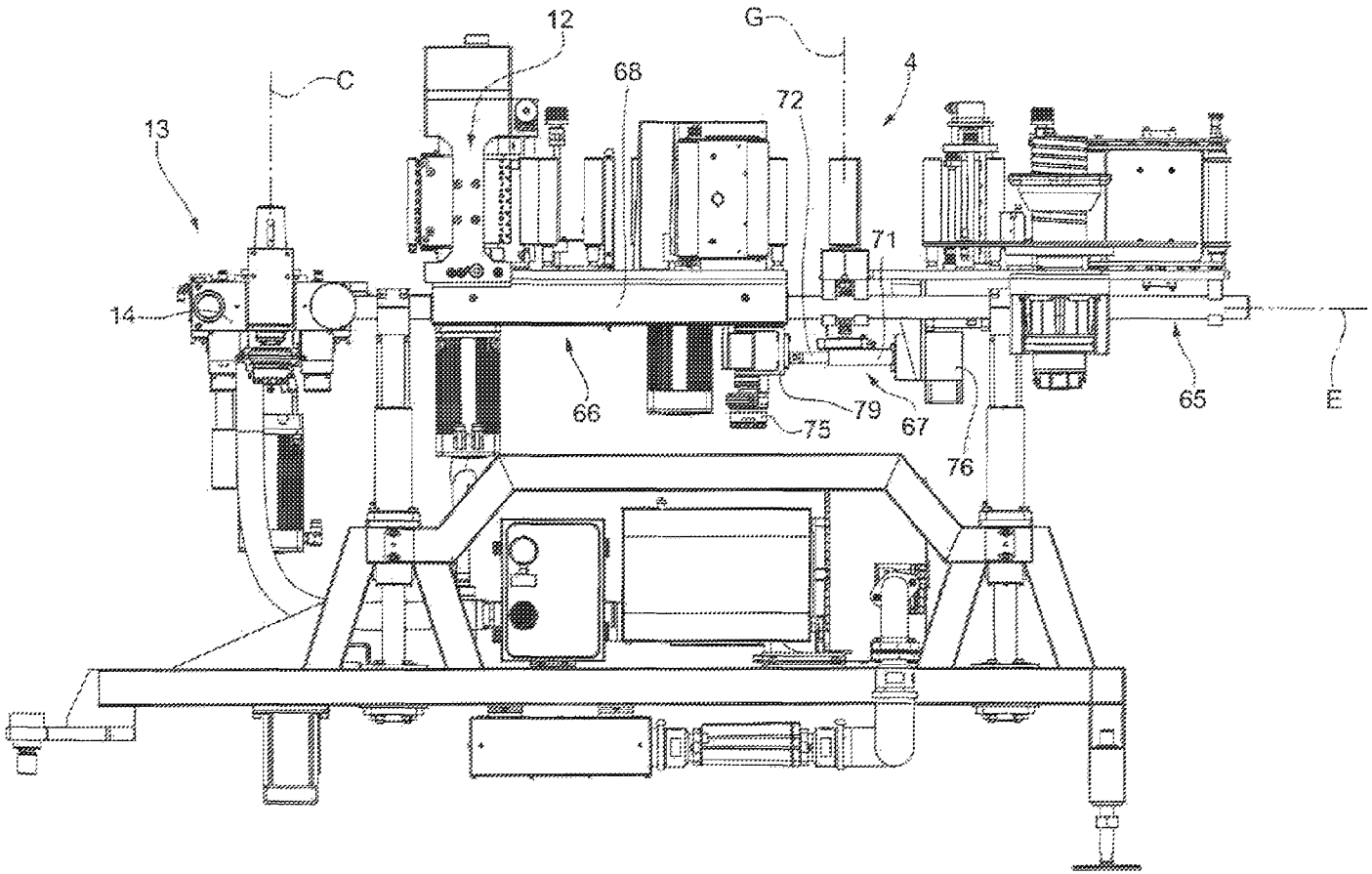
FIG. 6 is a frontal view of further components of the labelling group of FIGS. 2 to 5.
Figure 7:
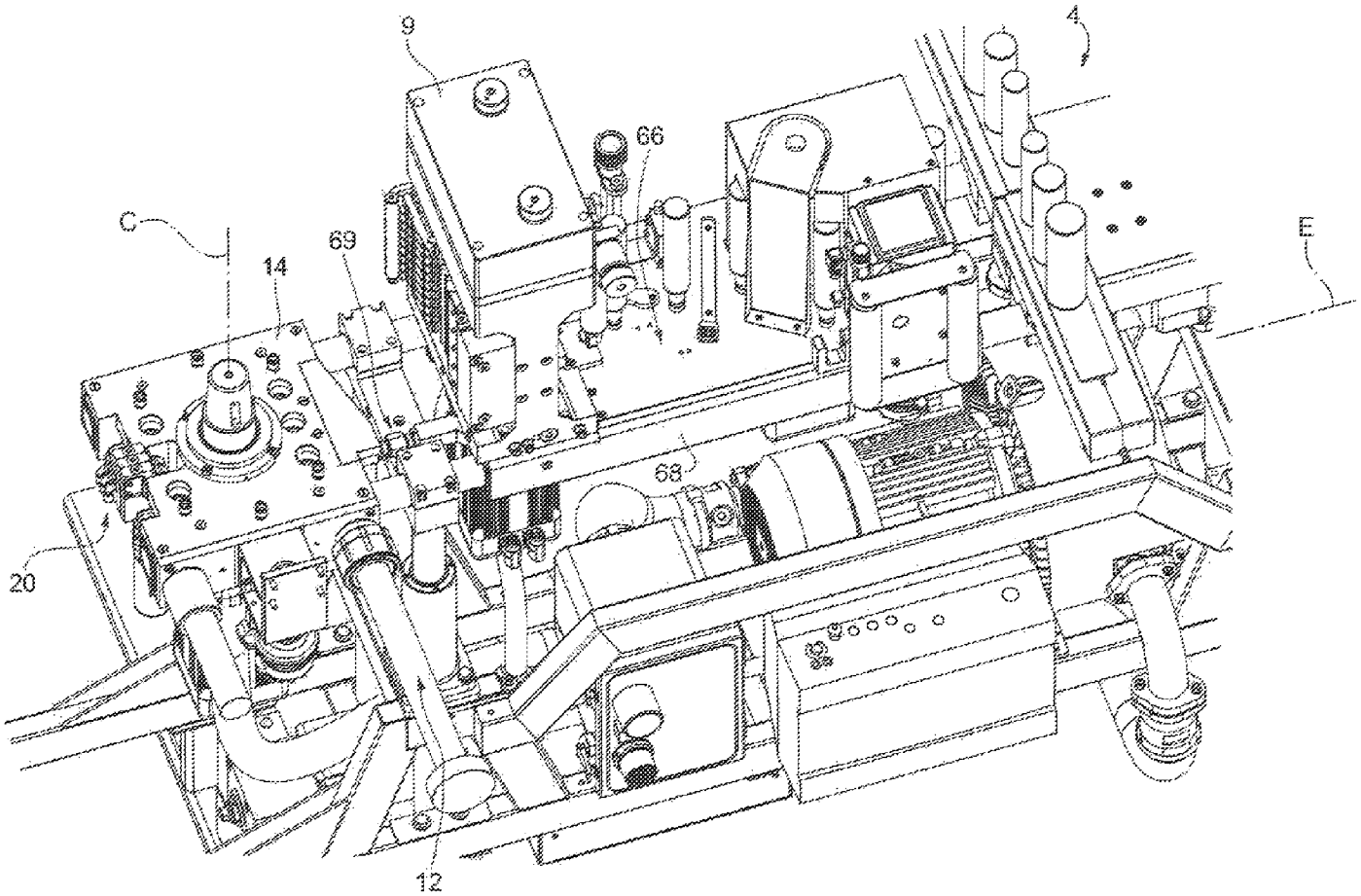
FIG. 7 is a perspective view of further components of the labelling group of FIGS. 2 to 6, with parts removed for clarity.
Figure 8:
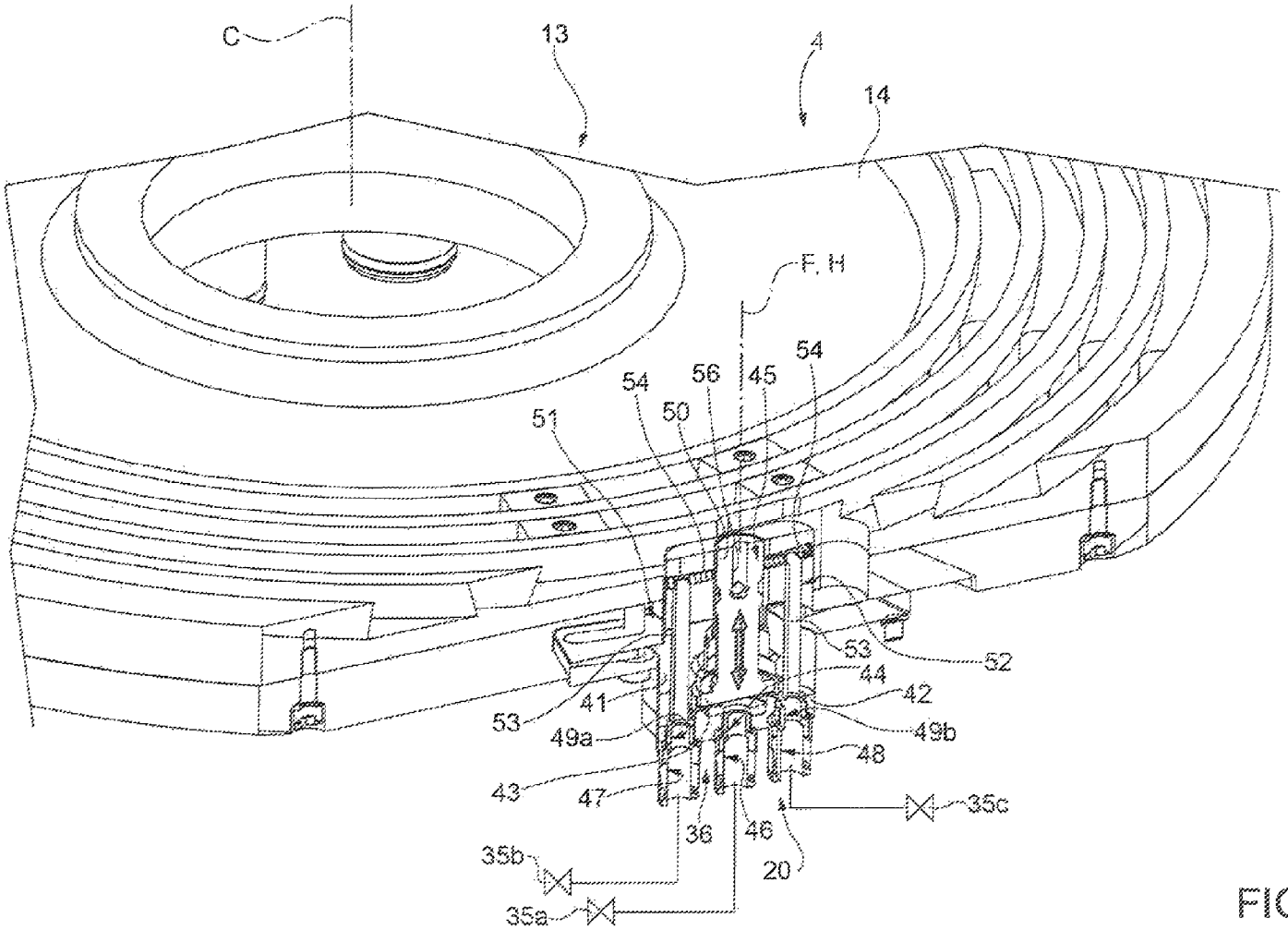
FIG. 8 is an enlarged perspective view of the labelling group of FIGS. 2 to 7 showing a diverting device, with parts removed for clarity.

With reference to FIGS. 6 and 7, supporting structure 66 comprises:

- a table 68 which supports a number of roller 16, cutting element 9 and glue roller 12; and
- a link 69, which is interposed between table 68 and stator 14.

Figure 3:
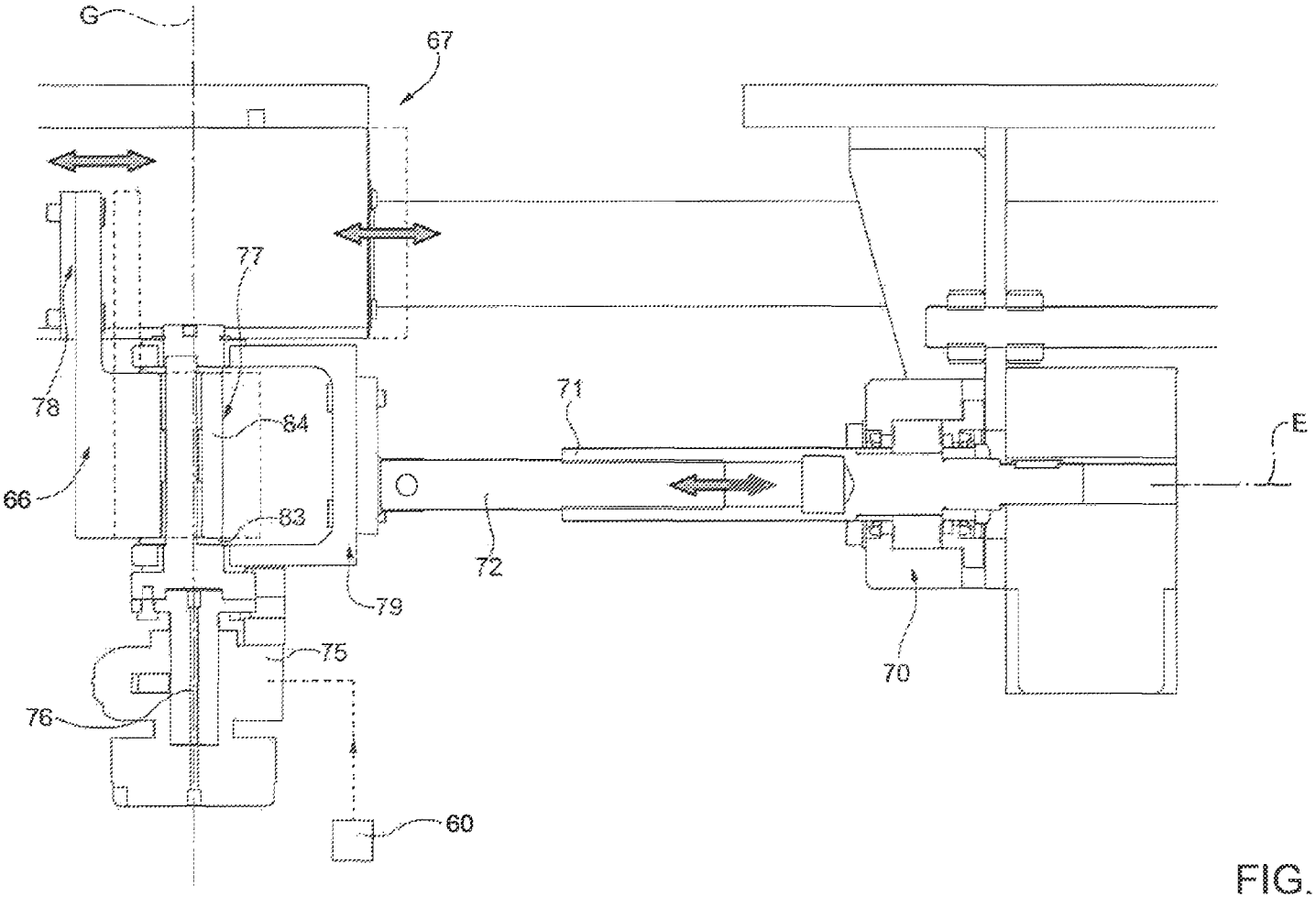
FIG. 3 is a section taken along line III-III of FIG. 2, with parts removed for clarity.
Figure 4:
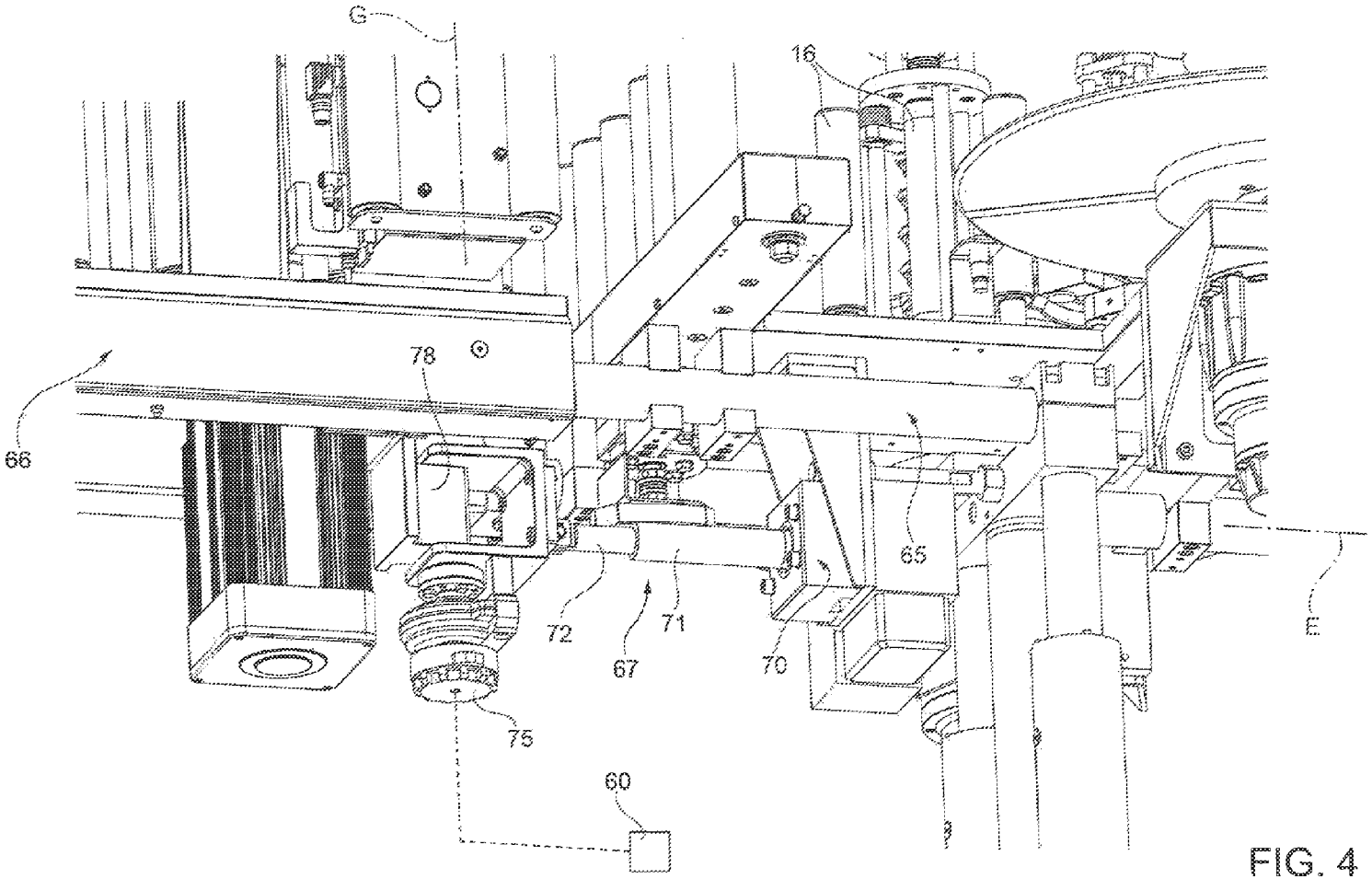
FIG. 4 is an enlarged perspective view of some components of the labelling group of FIGS. 2 and 3, with parts removed for clarity.
Figure 5:
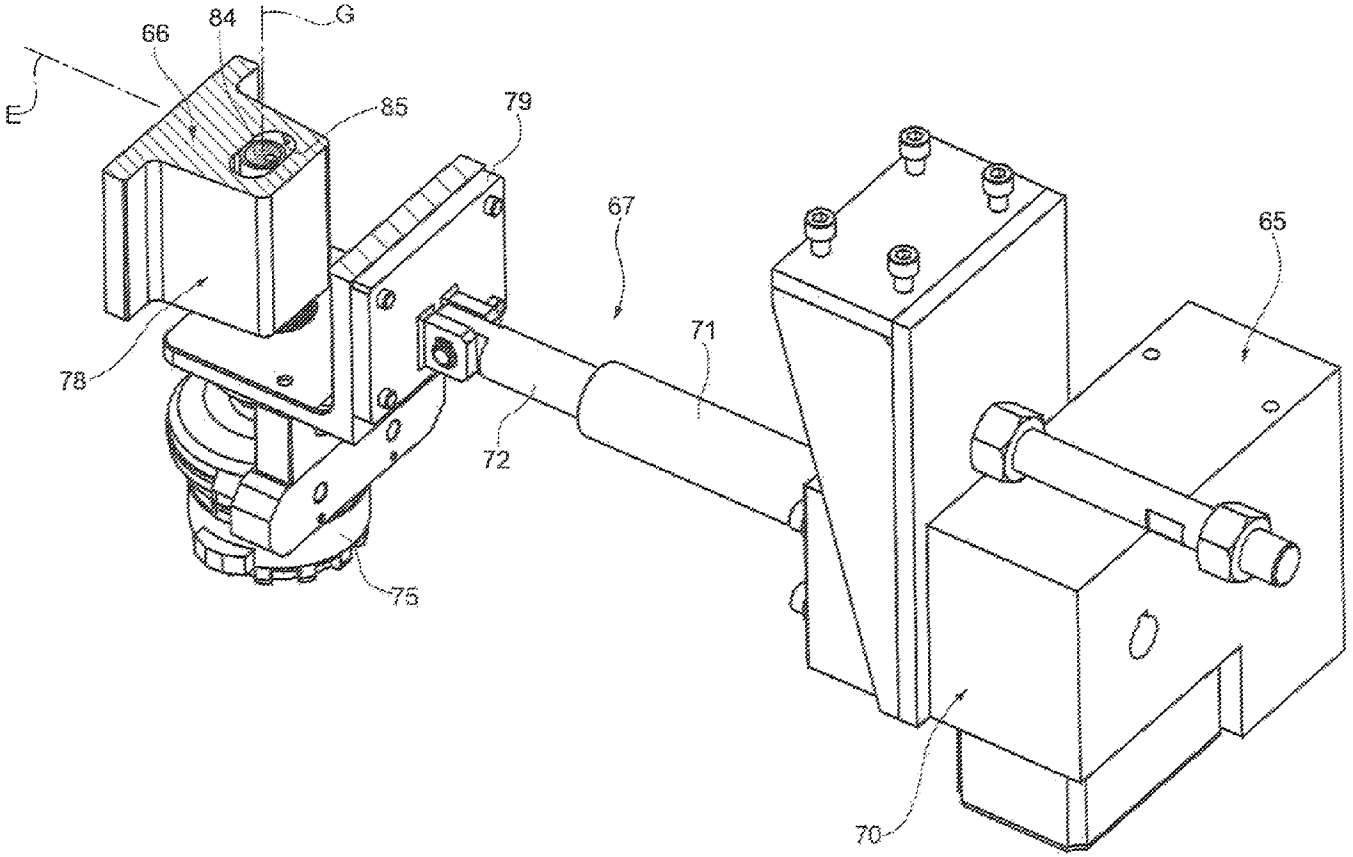
FIG. 5 is a further enlarged view of some components of the labelling group of FIGS. 2 to 4, with parts removed for clarity.

With reference to FIGS. 3 to 5, connecting means 67 comprise:

- a rotary actuator 70, which is supported by supporting structure 65;
- a shaft 71, which is driven in rotation by rotary actuator 70 about an its own axis parallel to direction E; and
- a rod 72, which is operatively connected to shaft 71.

Rod 72 and shaft 71 are operatively connected to each other, in such a way that the rotation of shaft 71 about an its own axis parallel to direction F causes the translation of rod 72 parallel to direction E.

In the embodiment shown, shaft 71 comprises, on the opposite side of rotary actuator 70, a portion with a male thread, which screws onto a female thread carried by a portion of rod 72. The female thread of rod 72 is, in particular, arranged on the side of rotary actuator 70.

Connecting means 67 further comprise

- a motor 75 controlled by control unit 60, and connected to rod 72, by means of a C-shaped element 79;
- a shaft 76 which is driven in rotation by motor 75 about an axis G;
- an element 77 which rotates integrally with shaft 76 about; axis G orthogonal to direction E; and
- a bracket 78, which is operatively connected to supporting structure 66, in particular to table 68.

Furthermore, bracket 78 and element 77 are coupled to each other, in such a way that the rotation of element 77 about axis G causes the sliding of bracket 78 parallel to direction E.

Still more precisely, element 77 comprises a first portion 83 fitted to shaft 76 and a second portion 84 protruding from portion 83 parallel to and spaced from axis C.

Portion 83 is housed in a slot 85 (FIG. 5) defined by bracket 78. Slot 85 has a width parallel to direction E substantially corresponding to the width of portion 84, and a length in a direction orthogonal to direction E and axis G greater than the length of portion 84.

Accordingly, when element 77 rotates about axis G driven by motor 75, portion 84 eccentrically rotates about axis G inside slot 85, so causing the movement of bracket 78 end, therefore, of supporting structure 66 parallel to direction E.

Preferably, rotary actuator 70 is operated for arranging transfer element 13 in the operative position, on the basis of the format of articles 11, 11*a*, 11*b* while motor 75 is controlled by control unit 60 for displacing transfer element 13 between the operative position and the fully rest position.

The operation of labelling machine 1 and plant 100 is described in the following, starting from a condition (FIG. 12) in which labelling group 4 is in the first operative configuration while labelling group 5 is in the second rest configuration.

Conveyor 101 advances a plurality of pre-forms 108 which are blown in the blowing machine, so as to form respective articles 11, 11*a*, 11*b*. Articles 11, 11*a*, 11*b* are filled inside the filling machine and fed to carousel 3 of labelling machine 1.

Carousel 3 rotates about axis A and conveys sequence of articles 11*a*, 11, 11*b* at substantially constant speed along path P from input station I to application stations B2, B1 and from application station B1 to output station O.

Diverting device 20 of labelling group 4 is in the first configuration and transfer station H of labelling group 4 coincides with application station B1.

Accordingly, transfer element 13 of labelling group 4 transfers, one after the other, labels 10*a* from reel 7*a* onto articles 11*a* travelling at application station B1.

In that condition, control unit 60 keeps the rotational speed of drum 15—and, therefore, of strip 8—of labelling group 4 at highest first speed value V1.

On the contrary, diverting device 20 of labelling group 5 is in the second configuration and transfer station H of labelling group 5 is spaced along direction E from by application station B2.

Accordingly, transfer element 13 of labelling group 5 idle, is prevented from transferring labels 10*b* onto articles 11*b* travelling at application station B2, and conveys labels 10*b* to sucking device 21 at discarding station D.

In other words, labelling group 4 acts as the "master" labelling group while labelling group 5 acts as the "slave" labelling group.

In case sensor 80 generates a signal associated to the fact that reel 7*a* is terminating, gap creating element 110 interrupts the flow of pre-forms 108 along conveyor 101.

After a given amount of time, switch 111 of element 110 allows again the flow of pre-forms 108 along conveyor 101.

Thus, gap 109 and, therefore, gap 82 is generated and is bounded by immediately adjacent downstream article 11*a* and immediately adjacent upstream article 11*b*.

Furthermore, control unit 60, as a consequence of that signal generated by sensor 80:

- moves diverting device 20 of labelling group 4 in the second configuration (FIGS. 13 to 15)
- moves supporting structure 66 and, therefore, transfer element 13 of labelling group 4 along direction E, so as to move labelling group 4 from the first operative configuration to the first rest configuration (FIGS. 13 to 15); and
- moves supporting structure 66 and, therefore, transfer element 13 of labelling group 5 along direction E, so as to move labelling group 5 from the second rest configuration to the second operative configuration (FIGS. 13 to 15).

When labelling group 5 has reached the second operative configuration, control unit 60 moves diverting device 20 of labelling group 5 in the first configuration (FIG. 14), so that transfer element 13 can release labels 10*b* onto articles 11*b* travelling at application station B2.

In this way, labelling group 4 now acts as the "slave" labelling group while labelling group 5 now acts as the "master" labelling group.

Control unit 60 is programmed for moving labelling group 4 from the first operative configuration to the first rest configuration, after relative drum 15 has transferred label 10*a* onto downstream immediately adjacent article 11*a* at application station B1.

Control unit 60 is also programmed for moving labelling group 5 to the second operative configuration, before upstream immediately adjacent article 11*b* has reached application station B2.

In other words, gap 82 moves along path between application stations B1, B2, after labelling group 4 has been moved away from the first operative configuration and before labelling group 5 has been set in the second operative configuration.

In this way, no articles 11, 11*a*, 11*b* remains unlabelled.

Figure 17:
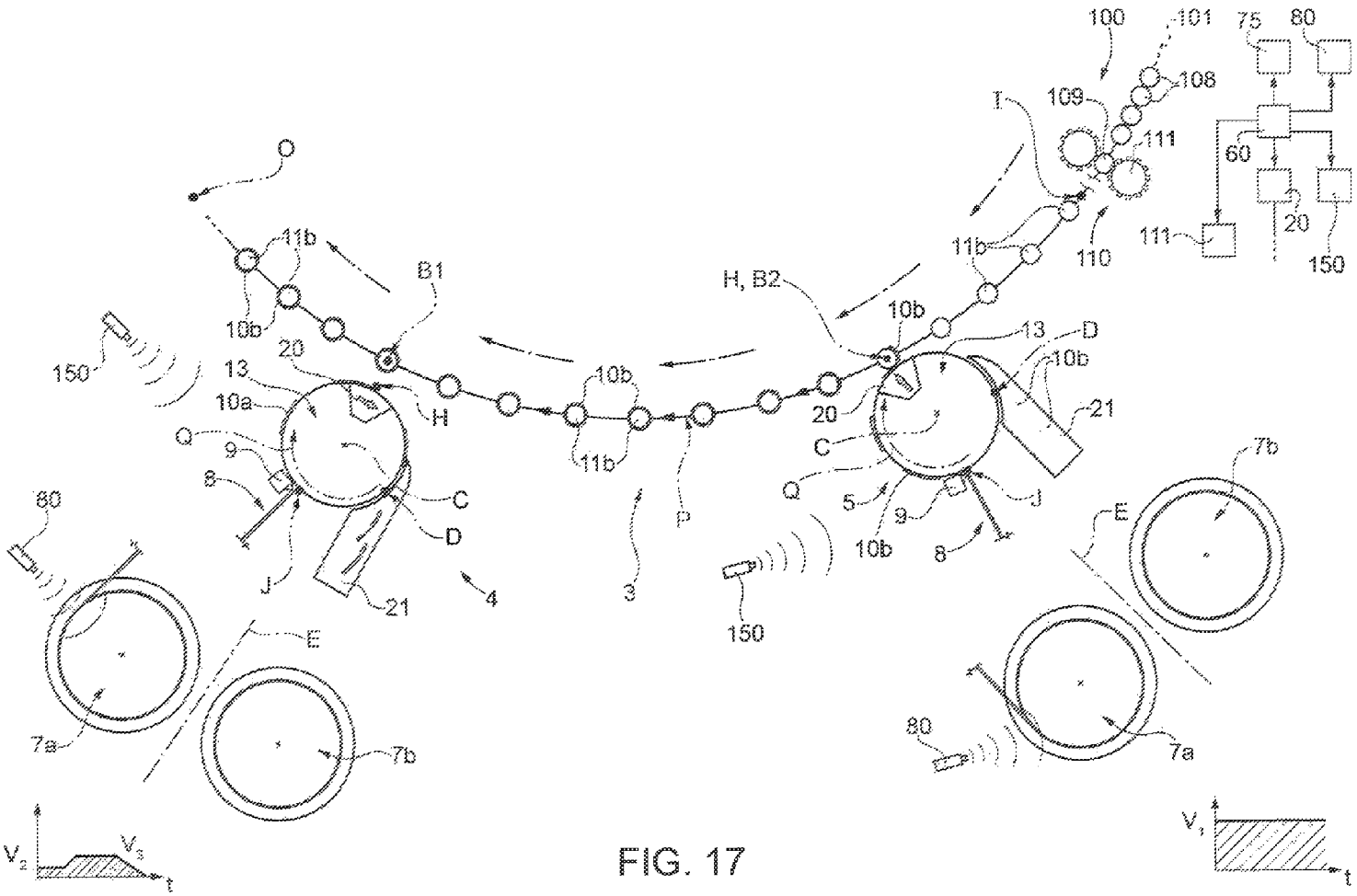
Figure 18:
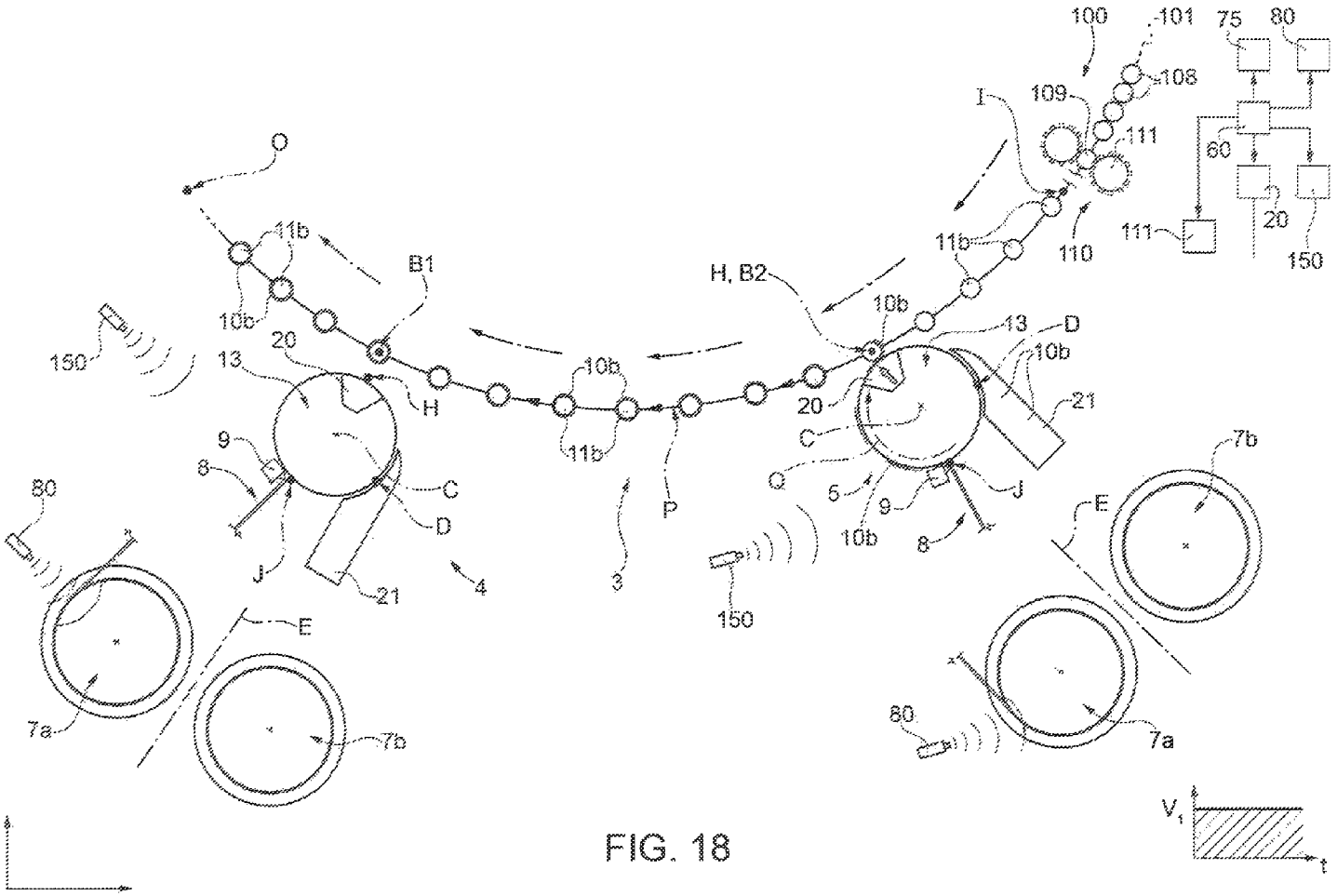

Still more precisely, control unit 60:

- decelerates, along a linear descending ramp in the embodiment shown, the speed of transfer element 13 (and therefore of strip 8) of labelling group 4 up to the second speed V2 reached when the latter is in the first rest configuration (FIG. 15)
- keeps transfer element. 13 (and therefore strip 8) of labelling group 4 at substantially null speed, when reel 7*b* is joined to reel 7*a* (FIG. 16);
- accelerates transfer element 13 (and therefore strip 8) at second speed V2 and then slows down transfer element 13 at null speed (FIG. 16);
- accelerates transfer element 13 (and therefore of strip 8) at third speed V3, according to a linear ascending ramp (FIG. 17); and
- decelerates transfer element 13 at null speed V3, according to a linear descending ramp (FIG. 17).

In particular, when transfer element 13 moves at second speed V2, visual control system 150 correct the correct positioning of labels 10*a* at discarding station D, thus checking out the correct joining of new reel 7*b* to reel 7*a*.

Furthermore, control unit 60 accelerates, according a liner ascending ramp in the embodiment shown in FIG. 13, the speed of transfer element 13 (and therefore of strip 8) of labelling group 5 up to speed V1.

With particular reference to FIG. 13, speed V1 is reached by transfer element 13 (and, therefore, of strip 8) of labelling group 5, before the latter reaches the second operative configuration shown in FIG. 15.

The operation of labelling machine 1 and plant 100 is now described with reference to FIGS. 19 to 21 and starting from the condition shown in which labelling group 4 is in the first operative configuration and labelling group 5 is in the second rest configuration.

In case sensor 85 detects that labelling group 4 is not properly applying labels 10*a* onto respective articles 11*a* at application station B1, expelling device 115 is operated to expel, for a certain amount of time, articles 11 from path P upstream of application station B2, with reference to the advancing direction of articles 11, 11*a*, 11*b* along path P (FIG. 19).

In this way, gap 82 is generated.

Furthermore, control unit 60, in response to the signal generated by sensor 85:

- moves diverting device 20 of labelling group 4 in the second configuration (FIG. 19)
- moves supporting structure 66 and, therefore, transfer element 13 of labelling group 4 along direction E, so as to move labelling group 4 from the first operative configuration to the first rest configuration (FIG. 19); and
- moves supporting structure 66 and, therefore, transfer element 13 of labelling group 5 along direction E, so as to move labelling group 5 from the rest configuration to the operative configuration (FIG. 20).

When labelling group 5 has reached the second operative configuration, control unit 60 moves diverting device 21 of labelling group 5 in the first configuration (FIG. 21), so that transfer element 13 can release labels 10*b* onto articles 11*b* travelling at application station B2.

In this way, labelling group 4 now acts as the "slave" labelling group while labelling group 5 now acts as the "master" labelling group (FIG. 21).

Still more precisely, control unit 60 slows down up to a null value the speed of transfer element 13—and therefore of strip 8—of labelling group 4, according to a liner descending ramp in the embodiment shown in FIG. 20.

Control unit 60 further accelerates the speed of transfer element 13—and, therefore, of strip 8, of labelling group 5, according to a liner ascending ramp in the embodiment shown in FIG. 19.

In the meanwhile, not properly labelled articles 11*b* are discarded at expelling device 120, which is arranged downstream of application station B1, with reference to the advancing direction of articles 11, 11*a*, 11*b* along path P.

From an analysis of the features of labelling machine 1 and method made according to the present invention, the advantages it allows to obtain are apparent.

In particular, gap creating element 110 creates gap 82 inside articles 11*a*, 11*b*.

In this way, in case the operation of one labelling group 4 (5) applying labels 10*a* (10*b*) onto articles ha (11*b*) and acting as the "master" labelling group needs to be interrupted, it is no longer necessary interrupting the operation of whole labelling machine 1 and of upstream machines of plant 100.

As a matter of fact, it is enough activating gap creating element 110 and moving the other labelling group 5 (4) acting as the "slave" labelling group from the second (first) rest configuration into the second (first) operative configuration.

In this way, the other labelling group 5 (4) can apply labels 10*b* (10*a*) onto articles 11*b* (11*a*).

Furthermore, control unit 60 is programmed for moving labelling group 4 from the first operative configuration to the first rest configuration after transfer element 13 of labelling group 4 has transferred label 10*a* onto immediately adjacent downstream article 11*a* at application station B1, while control unit 60 is programmed for moving labelling group 5 from second rest configuration to second operative position before transfer element 13 of labelling group transfer labels 10*b* onto immediately adjacent upstream article 11*b* at application station B2.

In this way, no articles 11*a*, 11*b* remains unlabelled.

In case reel 7*a* must be replaced (FIGS. 16 and 17), control unit 60 moves respective labelling group 4 (5) into the first (second) rest configuration and preferably arrests transfer element 13 and strip 8 of labelling group 4 (5).

Accordingly, new reel 7*b* can be joined to a substantially stationary reel 7*a*, regardless of the throughput of labelling machine 1.

In this way, when the joining of new reel 7*b* to reel 7*a* is carried out by non skilled technical staff or with automatic systems, here is substantially no risk to misalign new reel 7*b* with reel 7*a* and, therefore, there is substantially no risk of misaligning labels 10*a*, 10*b*.

Furthermore, when the labelling group 4 (5) is in the first (second) rest configuration and after new reel 7*b* has been joined to reel 7*a*, it is possible to control the position of cut labels 10*a* (10*b*) on drum 15 at discarding station D, by using visual control system 150.

In case sensor 85 detects that labelling group 4 (5) acting as the "master" labelling group is not properly applying labels 10*a* (10*b*) onto articles 11*a* (11*b*), control unit 60 moves labelling group 4 into the first (second) rest configuration and labelling group 5 (4) into the second (first) operative configuration (FIGS. 19 to 21).

In this way, it is possible to repair the labelling group 4 (5) set in the first (second) rest configuration, without interrupting the operation of labelling machine 1.

Finally, it is apparent that modifications and variants not departing from the scope of protection of the claims may be made to labelling machine 1 and to the method.

In particular, labelling group 4, 5 could comprise, instead of diverting device 20, a different device which can selectively deviate strip 8 from path Q upstream of cutting element 9.

In other words, that different device prevents strips 8 from reaching cutting element 9 and, therefore, drum 15.

Control unit 60 could be programmed for moving strip 8 and drum 15 of transfer element 13 of labelling groups 4, 5, according to different motion laws, when it moves transfer element 13 between the operative position and the fully rest position.

Furthermore, labelling machine 1 could comprise different kind of sensor for detecting that the operation of labelling group 4, 5 in the first (second) operative configuration needs to be interrupted.

Switch 111 could be used for interrupting the flow of pre-forms 108, in case sensor 85 detects that labelling group 4, 5 in the first (second) operative configuration is not properly transferring labels 10*a*, 10*b* to articles 11*a*, 11*b*.

Expulsing device 115 could be used for expelling articles 11 upstream of application stations B1, B2 in case reel 7*a* of labelling group 4, 5 in the first (second) operative configuration needs to be replaced.

The invention claimed is:

1. A labelling machine for applying labels to a succession of articles, the labelling machine comprising:

a conveyor for conveying a succession of articles to be labeled along a path;

a first labelling group configured to assume;

a first operative configuration, in which the first labelling group is configured to transfer labels to the succession of articles, and a first rest configuration, in which the first labelling group is prevented from transferring labels to the succession of articles;

a second labelling group configured to assume:

a second rest configuration, in which the second labelling group is prevented from transferring labels to the succession of articles, and a second operative configuration, in which the second labelling group is configured to transfer labels to the succession of articles;

a gap creating device including a switch configured to interrupt flow of articles along the path, the gap creating device configured to form a gap in the succession of articles; and a control unit configured to identify a predetermined condition of at least one of the conveyor, the first labelling group, and the second labelling group, wherein the control unit is further configured, upon identification of the predetermined condition, to:

transmit a signal to the gap creating device to form the gap in the succession of articles, and switch the first labelling group from the first operative configuration to the first rest configuration and switch the second labelling group from the second rest configuration to the second operative configuration.

2. The labelling machine of claim 1, wherein the gap in the succession of articles is bounded by an immediately adjacent upstream article and an immediately adjacent downstream article; and wherein the control unit is configured to:

switch the first labelling group from the first operative configuration to the first rest configuration, after the first labelling group transfers a label to the adjacent downstream article, and switch the second labelling group from the second rest configuration to the second operative configuration, prior to the second labelling group transferring a label to the adjacent upstream article.

3. The labelling machine of claim 1, wherein the first labelling group comprises at least one shaft configured to receive a reel of labels; and wherein the predetermined condition occurs when the reel is terminated.

4. The labelling machine of claim 1, wherein the gap creating device includes an expelling device configured to form the gap in the succession of articles by expelling an article upstream of the first labelling group and the second labelling group from the path.

5. The labelling machine of claim 1, wherein the path comprises:

a first application station, at which the first labelling group is configured to transfer labels to the succession of articles when the first labelling group is in the first operative configuration; and a second application station spaced from the first application station, at which the second labelling group is configured to transfer labels to the succession of articles when the second labelling group is in the second operative configuration, wherein the control unit is configured to switch the first labelling group from the first operative configuration to the first rest configuration, and for switching the second labelling group from the second rest configuration to the second operative configuration, when the gap in the succession of articles is between the second application station and the first application station.

6. The labelling machine of claim 1, wherein the conveyor is programmable for conveying the succession of articles along the path at a substantially constant speed.

7. The labelling machine of claim 1, wherein the first labelling group includes a diverting device and a transfer element for conveying at least one label;

the control unit being configured for selectively arranging the diverting device in:

a first configuration, in which the diverting device allows the transfer element to convey the at least one label along at least part of a trajectory and to release the at least one label at a transfer station; and in a second configuration, in which the diverting device prevents the transfer element either from receiving the at least one label or from releasing the at least one label to the transfer station;

wherein the control unit is configured to arrange the diverting device in the first configuration when the first labelling group is in the first operative configuration; and wherein the control unit is configured to arrange the diverting device in the second configuration either when the first labelling group moves from the first operative configuration to the first rest configuration or when the first labelling group is set in the first rest configuration.

8. The labelling machine of claim 7, wherein the first labelling group further includes a visual control system configured to control positioning of the at least one label conveyed by the transfer element.

9. A plant for producing a succession of articles, the plant comprising:

a labelling machine according to claim 1, wherein the conveyor is a first conveyor;

a second conveyor configured to convey a succession of pre-forms; and a blowing unit configured to blow the pre-forms of the succession of pre-forms, so as to form the articles of the succession of articles.

10. A labelling machine for applying labels to a succession of articles, the labelling machine comprising:

a carousel rotatable about an axis for conveying articles to be labeled along an arc-shaped path;

an input station in which the articles to be labeled are fed onto the carousel, a first labelling group situated downstream of the input station and peripherally with respect to the carousel, the first labelling group configured to assume a first operative configuration, in which the first labelling group is configured to transfer labels to articles at a first application station, and a first rest configuration, in which the first labelling group is prevented from transferring labels to the articles;

a second labelling group situated downstream of the first labelling group and peripherally with respect to the carousel, the second labelling group configured to assume a second operative configuration, in which the second labelling group is configured to transfer labels to articles at a second application station, and a second rest configuration, in which the second labelling group is prevented from transferring labels to the articles, wherein the second labelling group is configured to assume the second rest configuration when the first labelling group is in the first operative configuration, and the first labelling group is configured to assume the first rest configuration when the second labelling group is in the second operative configuration;

a gap creating device including a switch configured to interrupt flow of articles along the path, the gap creating device configured to form a gap in the succession of articles;

a control unit configured to switch the first labelling group from the first operative configuration to the first rest configuration and the second labelling group from the second rest configuration to the second operative configuration upon passage of the gap in the succession of articles along the arc-shaped path from the first application station to the second application station; and an output station in which labeled articles are output from the carousel.

11. The labelling machine of claim 10, wherein the control unit is configured to switch the first labelling group from the first operative configuration to the first rest configuration immediately after labelling an article immediately downstream of the gap in the succession of articles; and wherein the control unit is configured to switch the second labelling group from the second rest configuration to the second operative configuration for labelling the succession of articles starting with an article immediately upstream of the gap in the succession of articles, whereby none of the articles in the succession of articles remains unlabeled.

12. The labelling machine of claim 1, wherein the predetermined condition occurs when a sensor detects that at least one of the first labelling group and the second labelling group have applied a label to an incorrect position on at least one article.

* * * * *